US011542146B2

(12) United States Patent
McDougall et al.

(10) Patent No.: US 11,542,146 B2
(45) Date of Patent: Jan. 3, 2023

(54) SOLD OUT DETECTION USING A LEVEL SENSOR FOR A BEVERAGE DISPENSER

(71) Applicant: The Coca-Cola Company, Atlanta, GA (US)

(72) Inventors: Doug McDougall, Atlanta, GA (US); Brian Johnson, Kewaskum, WI (US); Dick P. Welch, Atlanta, GA (US); Caitlin Lahey, Atlanta, GA (US); Joshua Allen Maust, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 17/235,010

(22) Filed: Apr. 20, 2021

(65) Prior Publication Data

US 2021/0238022 A1 Aug. 5, 2021

Related U.S. Application Data

(63) Continuation of application No. 16/526,630, filed on Jul. 30, 2019, now Pat. No. 10,981,771, which is a continuation-in-part of application No. 16/474,816, filed as application No. PCT/US2017/068631 on Dec. 28, 2017, now Pat. No. 10,850,966.

(60) Provisional application No. 62/712,019, filed on Jul. 30, 2018, provisional application No. 62/443,411, filed on Jan. 6, 2017, provisional application No. 62/440,330, filed on Dec. 29, 2016.

(51) Int. Cl.

| | |
|---|---|
| ***B67D 1/08*** | (2006.01) |
| ***B67D 1/10*** | (2006.01) |
| ***B67D 1/12*** | (2006.01) |
| *B67D 1/00* | (2006.01) |

(52) U.S. Cl.

CPC ..... *B67D 1/0882* (2013.01); *B67D 1/0871* (2013.01); *B67D 1/10* (2013.01); *B67D 1/1247* (2013.01); *B67D 1/0021* (2013.01); *B67D 1/0025* (2013.01); *B67D 1/0079* (2013.01); *B67D 1/0888* (2013.01)

(58) Field of Classification Search

CPC ..... B67D 1/0882; B67D 1/0871; B67D 1/10; B67D 1/1247; B67D 1/0021; B67D 1/0025; B67D 1/0079; B67D 1/0888

See application file for complete search history.

(56) References Cited

U.S. PATENT DOCUMENTS 3,695,314 A 10/1972 Watts et al.
3,825,154 A 7/1974 Jaeger
(Continued)

FOREIGN PATENT DOCUMENTS

WO WO-01/30686 A1 5/2001

*Primary Examiner* — Frederick C Nicolas
(74) *Attorney, Agent, or Firm* — Foley & Lardner LLP

(57) ABSTRACT

A beverage dispenser for dispensing beverages and process may include a fluid container containing a fluid ingredient, a conduit fluidly connected to the fluid container, and an electrical conductivity sensor. The electrical conductivity sensor may be (i) fluidly connected to the conduit, and (ii) configured to sense an electrical conductivity of the fluid ingredient flowing through the conduit. The electrical conductivity sensor may further be configured to output (i) a first electrical signal in response to sensing an air bubble, and (ii) a second electrical signal in response to not sensing an air bubble.

20 Claims, 14 Drawing Sheets

(56) References Cited

U.S. PATENT DOCUMENTS

| | | | | |
|---|---|---|---|---|
| 4,319,568 | A | 3/1982 | Tregoning | |
| 4,911,330 | A | 3/1990 | Vlaanderen et al. | |
| 5,123,569 | A | 6/1992 | Lindner | |
| 5,765,726 | A | 6/1998 | Jones | |
| 6,196,418 | B1 | 3/2001 | McCann et al. | |
| 6,299,020 | B1 * | 10/2001 | Sudolcan | B67D 1/1243 222/64 |
| 6,675,989 | B1 | 1/2004 | Ritter et al. | |
| 8,562,584 | B2 | 10/2013 | Beiriger et al. | |
| 8,783,516 | B2 * | 7/2014 | Baak | B01F 35/7176 222/144.5 |
| 8,960,500 | B2 | 2/2015 | Van Opstal et al. | |
| 9,753,464 | B2 * | 9/2017 | Minard | G05D 9/00 |
| 9,815,678 | B2 | 11/2017 | Furberg et al. | |
| 10,850,966 | B2 * | 12/2020 | Lahey | B67D 1/004 |
| 10,981,771 | B2 * | 4/2021 | McDougall | B67D 1/0871 |
| 2005/0178793 | A1 | 8/2005 | Cheng et al. | |
| 2005/0242109 | A1 | 11/2005 | Reed | |
| 2006/0191954 | A1 | 8/2006 | Lowe | |
| 2006/0286262 | A1 | 12/2006 | Stearns et al. | |
| 2012/0074168 | A1 | 3/2012 | Newman | |
| 2012/0160871 | A1 | 6/2012 | Carpenter et al. | |
| 2012/0248137 | A1 | 10/2012 | Baak et al. | |
| 2014/0263406 | A1 | 9/2014 | Green et al. | |
| 2016/0193615 | A1 | 7/2016 | Schmid et al. | |
| 2019/0337789 | A1 | 11/2019 | Lahey et al. | |

* cited by examiner

SOLD OUT DETECTION USING A LEVEL SENSOR FOR A BEVERAGE DISPENSER

RELATED APPLICATIONS

This application is a Continuation of U.S. application having Ser. No. 16/526,630 filed Jul. 30, 2019 (U.S. Pat. No. 10,987,771), which claims priority to U.S. Provisional Application having application Ser. No. 62/712,019 filed Jul. 30, 2018 and is a Continuation-in-Part of U.S. application having Ser. No. 16/474,816 filed Jun. 28, 2019 (U.S. Pat. No. 10,850,966), which is a 371 National Phase Application that claims priority to PCT/US2017/068631 filed Dec. 28, 2017, which claims priority to U.S. Provisional Applications having Ser. No. 62/440,330 filed Dec. 29, 2016 and 62/443,411 filed Jan. 6, 2017; the contents of which are hereby incorporated by reference in their entirety.

BACKGROUND OF THE INVENTION

Beverage dispensers have become highly evolved over the years. Where beverage dispensers were once limited to a few number of ingredients, such as four to eight different ingredients, these days advanced dispensers may be configured with over 30 ingredients, and are capable of dispensing over 100 different beverages and nearly an infinite number of blends for users to create using the ingredients.

Current advanced dispensers are expensive to build and maintain due to technology needed to sense levels of the ingredients so that beverages poured include an accurate amount of the ingredients. As understood in the art, if a proper amount of ingredient is not included in a beverage, quality of the ingredient is dramatically affected, and branding of the beverage is immediately hurt for that customer. Moreover, the customer may complain to an operator, such as a restaurant, of the dispenser, which reduces productivity of workers of the operator.

Detecting levels of fluid ingredients of advance dispensers has proven to be difficult. There are a few types of beverage ingredients, including micro ingredients, macro ingredients, and a middle level of ingredients. Micro ingredients are generally acids and flavors that are highly concentrated and are able to produce a beverage using a high ratio (e.g., 150:1) of water or other beverage ingredient to the micro ingredient. Macro ingredients also include acids and flavors that are less concentrated and are used at a lower ratio (e.g., 5:1) of water or other beverage ingredient to the macro ingredient. Other mid-level ingredients may be used in concentration ratios (e.g., 50:1) that are between the micro and macro ingredients.

Because the micro ingredients can be used in such high ratio concentrations, the micro ingredients may be stored in containers, such as half-liter pouches, and still provide for a sufficient number beverage dispenses in a typical food outlet, such as a restaurant, of an operator of the dispenser. Macro ingredients are stored in containers that are much larger, such as 2.5, 3, or 5 gallon bags.

One of the main functions of a dispenser is to automatically identify when an ingredient is empty or otherwise sold out. Typical ways of determining when an ingredient is empty is to sense when air is within a fluid path of an ingredient. To perform the sensing, conventional techniques have included the use of a pressure sensor within a pump that is used to pump an ingredient from a fluid ingredient container and along a fluid path to a nozzle to dispense the ingredient into a beverage (e.g., cup).

One problem that occurs in beverage dispensers is that gaskets and other components can break down as a result of high concentrations of acids and salts in beverage ingredients, thereby enabling the fluid ingredients to leak from the fluid path into the pump so as to cause a pressure or other sensor in the pump to fail. A failure of a pressure sensor in a pump, therefore, requires that the entire pump be replaced. Depending upon the number of pumps within a dispenser, cost of replacing pumps can be very expensive, especially if a number of dispensers in the field are in the thousands.

Another technique for sensing air within a fluid path of an ingredient includes the use of an optical sensor that senses air bubbles. In the case of micro ingredients, it is typical that a certain number of milliliters of air gets into a half-liter container used to store the ingredient. In the case of macro ingredients, a corresponding number of milliliters of air may be contained within a 3 gallon bag. If a small air bubble enters the fluid stream of the ingredient, a pressure sensor does not sense a small air bubble, but an optical sensor does detect a small air bubble. The optical sensor may trigger a false positive in response to a small air bubble of the ingredient being empty, while a pressure sensor may not sense an empty condition soon enough. As a result of falsely sensing that an ingredient is empty, the dispenser may prevent further use of the ingredient in making beverages until the ingredient container is replaced, which requires time for an operator to make the replacement.

Other dispenser designs include the use a small tank with an air vent at the top of the tank. The tank is filled with an ingredient between dispenses of an ingredient, and the fluid ingredient is drawn from the bottom of the tank so as to avoid air bubbles from entering the fluid path. Moreover, the tanks consume a fair amount of space within a dispenser, thereby causing a footprint of the dispenser to be increased. Even with the tanks, sensors to sense whether a beverage ingredient is empty as previously described are required as a safety precaution (i.e., to maintain quality beverages), so adding the tanks to the dispensers is an added expense despite the improved operation of the dispenser.

Moreover, because micro-ingredients are used in such high ratios, a small difference in the amount of micro-ingredient that is used to produce a beverage can result in an out-of-spec beverage being poured. As understood in the art, when even a small air bubble enters a line or conduit from a micro-ingredient container through which the micro-ingredient flows, the micro-ingredient and air bubble may exit a nozzle when a beverage is dispensed. It is well known that taste of a beverage is negatively impacted if a proper amount of ingredient, especially micro-ingredient, is not used to form the beverage. As further known, it is difficult to remove air bubbles from fluid lines. As a result, there is a need to prevent air bubbles from exiting nozzles of a beverage dispenser or from entering a fluid path in which air could potentially exit a nozzle.

Another problem that exists is that air bubbles often cause air bubble sensors to detect that an air bubble is in a line, and may cause a beverage dispenser to incorrectly determine that the ingredient container is actually empty when often the container is not yet empty, thereby (i) causing disruption to beverage dispensing and business operations, and (ii) adding unnecessary cost to operators and ingredient producers. For example, it is a common practice for a supplier of the beverage ingredients to apply credits to an operator if containers of ingredients are not fully consumed, which occurs when incorrect empty ingredient cartridge condition determinations are made due to air bubbles being sensed.

One technique for preventing air bubbles exiting nozzles when dispensing beverages from a beverage dispenser is to prime a line of a fluid ingredient, including a micro-ingredient, after a new ingredient container is fluidly connected to a line because replacing ingredient containers, no matter how carefully performed, causes an air bubble to enter the line through which the ingredient travels to a pump and out of the nozzle for dispensing into a beverage. Moreover, as an ingredient container is depleted, air enters a conduit and other fluid path components (e.g., air bubble sensor), which needs to be removed from the fluid path, as well. In priming the line (i.e., fluid path), the pump is operated to output the ingredient from the dispenser until the air bubble in the line exits the nozzle. The problem with priming the line, however, is that a number of beverages are "lost," especially in the case of the ingredient being a micro-ingredient, due to ingredient in the line being output from the nozzle.

As a result of the shortcomings of existing beverage dispensers, there is a need for a low cost technique to sense fluid ingredients in a more accurate manner over a long period of time so that more ingredient can be dispensed from an ingredient container, thereby reducing overall cost for operators and ingredient suppliers. More specifically, as a result of air bubbles entering the fluid lines of liquid ingredients, especially micro-ingredients, there is further a need to remove the air bubbles from the fluid lines in a manner that avoids producing beverages that do not meet flavor specifications and that minimizes loss of ingredient, and, thus, a reduced number of beverages that can be dispensed by the dispenser from ingredient containers.

SUMMARY OF THE INVENTION

A more robust and cost effective beverage dispenser may be produced by using a resistance or conductivity sensor within each fluid path of a fluid ingredient at the dispenser. The conductivity sensor may be formed by using a pair of electrodes placed within the fluid path and measuring electrical conductivity of the fluid ingredient. In an embodiment, the electrodes may be configured within a connector. The connector may be positioned externally from a pump, thereby avoiding having to replace the pump in the event that the conductivity sensor fails. The conductivity sensor may be inexpensive relative to other sensors, such as pressure or optical sensors, thereby providing for a cost-effective solution for production and maintenance of a beverage dispenser.

One embodiment of a beverage dispenser for dispensing beverages may include a fluid container containing a fluid ingredient, a conduit fluidly connected to the fluid container, and an electrical conductivity sensor. The electrical conductivity sensor may be (i) fluidly connected to the conduit, and (ii) configured to sense an electrical conductivity of the fluid ingredient flowing through the conduit. The electrical conductivity sensor may further be configured to output (i) a first electrical signal in response to sensing an air bubble, and (ii) a second electrical signal in response to not sensing an air bubble.

One embodiment of a process of dispensing beverages from a beverage dispenser may include causing an ingredient in the form of a fluid to be drawn from a storage container through a conduit. An electrical conductivity of the fluid ingredient may be sensed within the conduit. A determination as to whether the electrical conductivity of the fluid ingredient crosses a threshold level may be made, and if so, the beverage dispenser may be disabled from dispensing beverages containing the fluid ingredient, otherwise, the beverage dispenser may be enabled to dispense beverages containing the fluid ingredient.

One embodiment of a beverage dispenser for dispensing beverages may include a non-transitory memory configured to store data. A storage container may be configured to store a fluid ingredient for use in producing a beverage. At least one conduit may extend from the storage container to enable the fluid ingredient to flow to an output for dispensing into a beverage being poured by the dispenser. A pump may be in fluid communication with the conduits, and be configured to pump the fluid ingredient through the conduits. A dispenser nozzle may be in fluid communication with the conduit and pump, and be configured to dispense the fluid ingredient therefrom. An electrical conductivity sensor may be configured to sense an electrical conductivity of the fluid ingredient within the conduit. A processing unit may be configured to receive electrical conductivity measurements from the electrical conductivity sensor, and further be configured to determine whether the electrical conductivity of the fluid ingredient crosses a threshold level, and if so, disable the beverage dispenser from dispensing beverages containing the fluid ingredient, otherwise, enable the beverage dispenser to dispense beverages containing the fluid ingredient.

One embodiment of a process of manufacturing a beverage dispenser may include disposing a micro-ingredient container. A two-way pump may be disposed in the beverage dispenser. A conduit may be fluidly connected between the micro-ingredient container and the two-way pump to enable the two-way pump (i) to pump micro-ingredient liquid contained within the micro-ingredient container through the conduit, and (ii) to pump the micro-ingredient and any air bubbles contained therein via the conduit into the micro-ingredient container.

One embodiment of a process of dispensing a beverage may include pumping a micro-ingredient from a micro-ingredient container via a fluid path toward a nozzle to dispense a beverage inclusive of the micro-ingredient. The micro-ingredient may be reverse pumped via the fluid path back to the micro-ingredient container to cause an air bubble in the fluid path to be pushed into the micro-ingredient container.

An embodiment of a beverage dispenser may include an ingredient container including an ingredient used to produce a beverage. A bi-directional pump may be configured to pump fluid in either of a forward direction or a reverse direction. A first conduit may be fluidly connected to the ingredient container and bi-directional pump. A nozzle may be configured to output beverage ingredients from the beverage dispenser. A second conduit may be fluidly connected to the bi-directional pump and the nozzle. A processing unit may be in communication with the bi-directional pump, and be configured to command the bi-directional pump to pump an ingredient in a forward direction or a reverse direction.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION OF THE INVENTION

Figure 1:
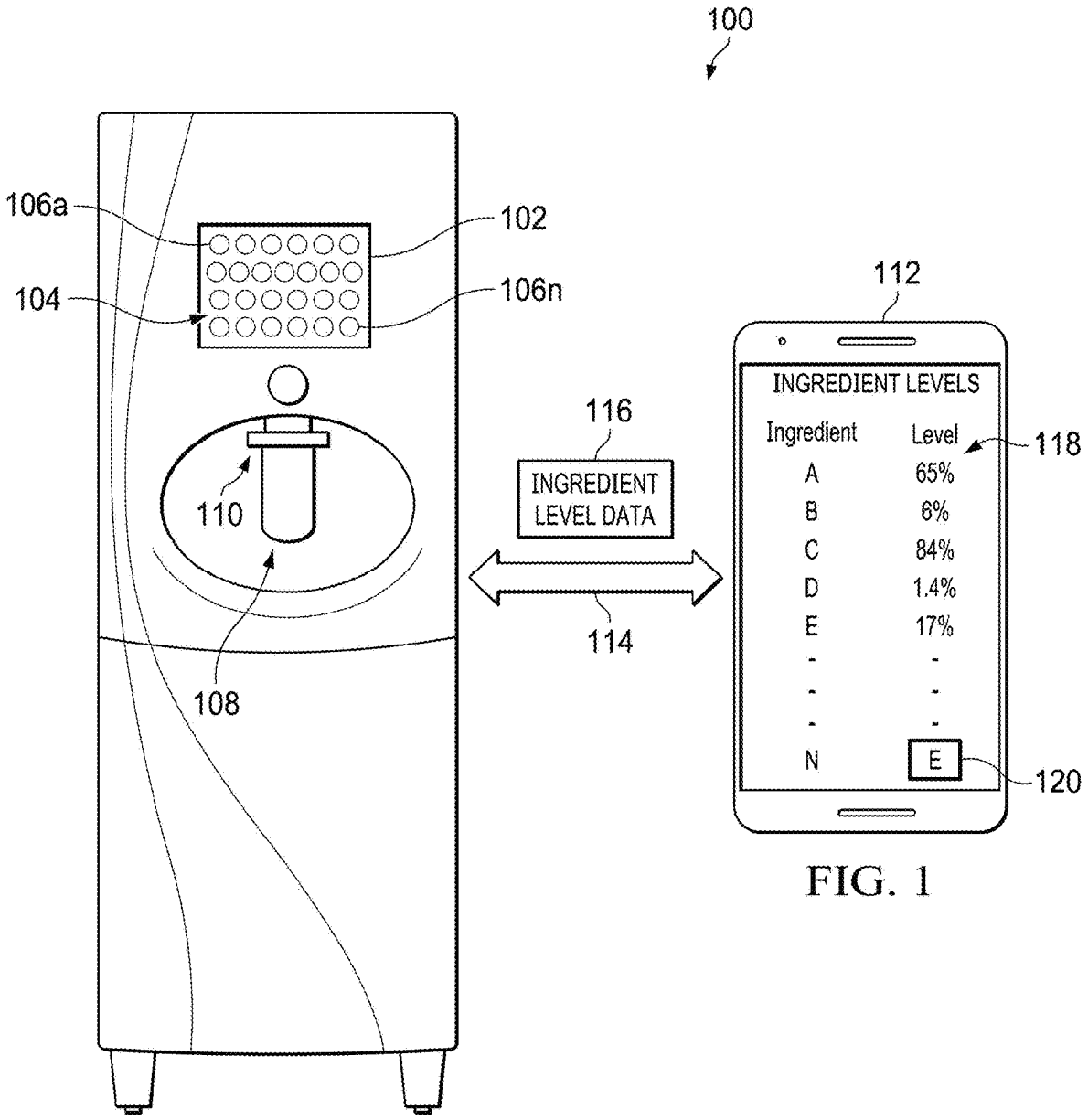
FIG. 1 is an illustration of an illustrative beverage dispenser inclusive of a resistance or electrical conductivity sensor for monitoring fluid ingredient level status.

With regard to FIG. 1, an illustration of an illustrative beverage dispenser 100 inclusive of a resistance or electrical conductivity sensor for monitoring fluid ingredient level status is shown. As understood in the art, beverage dispensers are used for enabling food outlets to dispense beverages inclusive of brands and flavors to customers. Beverage dispensers have a wide range of capabilities, and newer more advanced beverage dispensers provide an electronic display 102 on which a user interface 104 enables users to select from multiple available beverage brands and/or flavors. The beverage dispenser 100 is an advanced beverage dispenser, and is configured to dispense both micro and macro ingredients. The user interface 104 may be displayed with selectable icons 106*a*-106*n* (collectively 106) of beverages available to be dispensed by the dispenser 100 are shown. A user may select one of the icons 104 to activate a pump (see FIGS. 2A and 2B) to cause one or more fluid ingredients to be dispensed into a cup (not shown) that is placed in a dispenser region 108 beneath a dispenser nozzle 110 in dispensing a selected beverage. The dispenser 100 may be configured with conductivity sensors (see FIGS. 2A and 2B) within fluid paths of each of the fluid ingredients to sense when a fluid ingredient is empty or sold out. Alternatively, if the fluid paths of each of the fluid ingredients converge to a converged fluid path, a conductivity sensor may be established in the converged fluid path.

To operate the dispenser 100, a processing unit (see FIGS. 2A and 2B) may be configured to operate the user interface 104, and control functional devices, such as pumps, within the dispenser in response to users selecting to dispense particular beverages that use the same or different ingredient(s). The dispenser 100 may continuously, periodically, or in response to events (e.g., dispensing of a particular fluid ingredient) monitor levels of ingredient(s). In response to detecting that a fluid ingredient is empty, the dispenser may be disabled to dispense beverages using that fluid ingredient, as further described herein.

The dispenser 100 may further be configured to communicate with a remote electronic device 112, such as a smart mobile telephone executing an app that provides information to an operator of the dispenser, via a communications network 114. The communications network 114 may be a local communications network, such as a WiFi® or Bluetooth® communications network or wide area network, such as the Internet, mobile communications network, etc. The dispenser 100 may communicate ingredient level data 116 to the electronic device 112 for display on a user interface 118. The ingredient level data 116 may include ingredient names or identifiers (e.g., "Ingredient Slot A") and associated measured or estimated levels. In an embodiment, the dispenser may sense that an ingredient is empty or sold out, and communicate an empty status of the ingredient to the electronic device 112 for displaying an empty indicator 120, such as a highlighted "E," for the operator to view. It should be understood that alternative user interfaces and notifications may be used to provide the ingredient level data 116 and status notifications of a beverage ingredient being empty.

Furthermore, the nozzle 110 may be in communication with a number of beverage components. In some instances, the nozzle 110 may mix the beverage components to form a beverage. Any number of beverage components may be used herein. The beverage components may include water and/or carbonated water. In addition, the beverage components may include a number of micro-ingredients and one or more macro-ingredients.

Generally described, the macro-ingredients may have reconstitution ratios in the range from full strength (i.e., no dilution) to about six-to-one (6:1), but generally less than about ten-to-one (10:1). As used herein, the reconstitution ratio refers to the ratio of diluent (e.g., water or carbonated water) to beverage ingredient. Therefore, a macro-ingredient with a 5:1 reconstitution ratio refers to a macro-ingredient that is to be mixed with five parts diluent for every part of the macro-ingredient in the finished beverage. Many macro-ingredients may have reconstitution ratios in the range of about 3:1 to 5.5:1, including 4.5:1, 4.75:1, 5:1, 5.25:1, and 5.5:1 reconstitution ratios. The macro-ingredients may include sweeteners, such as sugar syrup, HFCS ("High Fructose Corn Syrup"), FIS ("Fully Inverted Sugar"), MIS ("Medium Inverted Sugar"), mid-calorie sweeteners comprised of nutritive and non-nutritive or high intensity sweetener blends, and other such nutritive sweeteners that are difficult to pump and accurately meter at concentrations greater than about 10:1—particularly after having been cooled to standard beverage dispensing temperatures of around 35-45 degrees Fahrenheit. An erythritol sweetener may also be considered a macro-ingredient sweetener when used as the primary sweetener source for a beverage, though typically erythritol may be blended with other sweetener sources and used in solutions with higher reconstitution ratios such that erythritol may be considered a micro-ingredient as described hereinbelow.

The macro-ingredients may also include concentrated extracts, purees, and similar types of ingredients. Other ingredients may include traditional BIB ("bag-in-box") flavored syrups (e.g., COCA-COLA® bag-in-box syrup), juice concentrates, dairy products, soy, and rice concentrates. Similarly, a macro-ingredient base product may include the sweetener as well as flavorings, acids, and other common components of a beverage syrup. The beverage syrup with sugar, HFCS, or other macro-ingredient base products generally may be stored in a conventional bag-in-box container remote from the dispenser. The viscosity of the macro-ingredients may range from about 1 to about 10,000 centipoise and generally over 100 centipoises or so when chilled. Other types of macro-ingredients may be used herein.

The micro-ingredients may have reconstitution ratios ranging from about ten-to-one (10:1) and higher. Specifically, many micro-ingredients may have reconstitution ratios in the range of about 20:1, to 50:1, to 100:1, to 300:1, or higher. The viscosities of the micro-ingredients typically range from about one (1) to about six (6) centipoise or so, but may vary from this range. Examples of micro-ingredients include natural or artificial flavors; flavor additives; natural or artificial colors; artificial sweeteners (high potency, nonnutritive, or otherwise); antifoam agents, nonnutritive ingredients, additives for controlling tartness, e.g., citric acid or potassium citrate; functional additives, such as vitamins, minerals, herbal extracts, nutriceuticals; and over-the-counter (or otherwise) medicines, such as pseudoephedrine, acetaminophen; and similar types of ingredients. Various acids may be used in micro-ingredients including food acid concentrates, such as phosphoric acid, citric acid, malic acid, or any other such common food acids. Various types of alcohols may be used as either macro- or micro-ingredients. The micro-ingredients may be in liquid, gaseous, or powder form (and/or combinations thereof including soluble and suspended ingredients in a variety of media, including water, organic solvents, and oils). Other types of micro-ingredients may be used herein.

Typically, micro-ingredients for a finished beverage product include separately stored non-sweetener beverage component concentrates that constitute the flavor components of the finished beverage. Non-sweetener beverage component concentrates do not act as a primary sweetener source for the finished beverage and do not contain added sweeteners, though some non-sweetener beverage component concentrates may have sweet tasting flavor components or flavor components that are perceived as sweet therein. These non-sweetener beverage component concentrates may include the food acid concentrate and food acid-degradable (or non-acid) concentrate components of the flavor, such as described in commonly owned U.S. patent application Ser. No. 11/276,553, entitled "Methods and Apparatus for Making Compositions Comprising and Acid and Acid Degradable Component and/or Compositions Comprising a Plurality of Selectable Components." As noted above, micro-ingredients may have reconstitution ratios ranging from about ten-to-one (10:1) and higher, where the micro-ingredients for the separately stored non-sweetener beverage component concentrates that constitute the flavor components of the finished beverage typically have reconstitution ratios ranging from 50:1, 75:1, 100:1, 150:1, 300:1, or higher.

For example, the non-sweetener flavor components of a cola finished beverage may be provided from separately stored first non-sweetener beverage component concentrate and a second non-sweetener beverage component concentrate. The first non-sweetener beverage component concentrate may comprise the food acid concentrate components of the cola finished beverage, such as phosphoric acid. The second non-sweetener beverage component concentrate may comprise the food acid-degradable concentrate components of the cola finished beverage, such as flavor oils that would react with and impact the taste and shelf life of a non-sweetener beverage component concentrate if stored with the phosphoric acid or other food acid concentrate components separately stored in the first non-sweetener component concentrate. While the second non-sweetener beverage component concentrate does not include the food acid concentrate components of the first non-sweetener beverage component concentrate (e.g., phosphoric acid), the second non-sweetener beverage component concentrate may still be a high-acid beverage component solution (e.g., pH less than 4.6).

A finished beverage may have multiple non-sweetener concentrate components of the flavor other than the acid concentrate component of the finished beverage. For example, the non-sweetener flavor components of a cherry cola finished beverage may be provided from the separately stored non-sweetener beverage component concentrates described in the above example as well as a cherry non-sweetener component concentrate. The cherry non-sweetener component concentrate may be dispensed in an amount consistent with a recipe for the cherry cola finished beverage. Such a recipe may have more, less, or the same amount of the cherry non-sweetener component concentrate than other recipes for other finished beverages that include the cherry non-sweetener component concentrate. For example, the amount of cherry specified in the recipe for a cherry cola finished beverage may be more than the amount of cherry specified in the recipe for a cherry lemon-lime finished beverage to provide an optimal taste profile for each of the finished beverage versions. Such recipe-based flavor versions of finished beverages are to be contrasted with the addition of flavor additives or flavor shots as described below.

Other typical micro-ingredients for a finished beverage product may include micro-ingredient sweeteners. Micro-ingredient sweeteners may include high intensity sweeteners such as aspartame, Ace-K, steviol glycosides (e.g., Reb A, Reb M), sucralose, saccharin, or combinations thereof. Micro-ingredient sweeteners may also include erythritol when dispensed in combination with one or more other sweetener sources or when using blends of erythritol and one or more high intensity sweeteners as a single sweetener source.

Other typical micro-ingredients for supplementing a finished beverage product may include micro-ingredient flavor additives. Micro-ingredient flavor additives may include additional flavor options that can be added to a base beverage flavor. The micro-ingredient flavor additives may be non-sweetener beverage component concentrates. For example, a base beverage may be a cola flavored beverage, whereas cherry, lime, lemon, orange, and the like may be added to the cola beverage as flavor additives, sometimes referred to as flavor shots. In contrast to recipe-based flavor versions of finished beverages, the amount of micro-ingredient flavor additive added to supplement a finished beverage may be consistent among different finished beverages. For example, the amount of cherry non-sweetener component concentrate included as a flavor additive or flavor shot in a cola finished beverage may be the same as the amount of cherry non-sweetener component concentrate included as a flavor additive or flavor shot in a lemon-lime finished beverage. Additionally, whereas a recipe-based flavor version of a finished beverage is selectable via a single finished beverage selection icon or button (e.g., cherry cola icon/button), a flavor additive or flavor shot is a supplemental selection in addition to the finished beverage selection icon or button (e.g., cola icon/button selection followed by a cherry icon/button selection).

As is generally understood, such beverage selections may be made through a touchscreen user interface or other typical beverage user interface selection mechanism (e.g., buttons) on the beverage dispenser. The selected beverage, including any selected flavor additives, may then be dispensed upon the beverage dispenser 100 receiving a further dispense command through a separate dispense button on the touchscreen user interface or through interaction with a separate pour mechanism, such as a pour button (electromechanical, capacitive touch, or otherwise) or pour lever.

In the traditional BIB flavored syrup delivery of a finished beverage, a macro-ingredient flavored syrup that contains all of a finished beverage's sweetener, flavors, and acids is mixed with a diluent source, such as plain or carbonated water in ratios of around 3:1 to 6:1 of diluent to the syrup. In contrast, for a micro-ingredient delivery of a finished beverage, the sweetener(s) and the non-sweetener beverage component concentrates of the finished beverage are all separately stored and mixed together about a nozzle when the finished beverage is dispensed. Example nozzles suitable for dispensing of such micro-ingredients include those described in commonly owned U.S. provisional patent application Ser. No. 62/433,886 entitled "Dispensing Nozzle Assembly," PCT patent application Ser. No. PCT/US15/026657 entitled "Common Dispensing Nozzle Assembly," U.S. Pat. No. 7,866,509 entitled "Dispensing Nozzle Assembly," or U.S. Pat. No. 7,578,415 entitled "Dispensing Nozzle Assembly."

In operation, the beverage dispenser 100 may dispense finished beverages from any one or more of the macro-ingredient or micro-ingredient sources described above. For example, similar to the traditional BIB flavored syrup delivery of a finished beverage, a macro-ingredient flavored syrup may be dispensed with a diluent source such as plain or carbonated water to produce a finished beverage. Additionally, the traditional BIB flavored syrup may be dispensed with the diluent and one or more micro-ingredient flavor additives to increase the variety of beverages offered by the beverage dispenser 100.

Micro-ingredient-based finished beverages may be dispensed by separately dispensing each of the two or more non-sweetener beverage component concentrates of the finished beverage along with a sweetener and diluent. The sweetener may be a macro-ingredient sweetener or a micro-ingredient sweetener and the diluent may be water or carbonated water. For example, a micro-ingredient-based cola finished beverage may be dispensed by separately dispensing a food acid concentrate components of the cola finished beverage, such as phosphoric acid, food acid-degradable concentrate components of the cola finished beverage, such as flavor oils, macro-ingredient sweetener, such as HFCS, and carbonated water. In another example, a micro-ingredient-based diet-cola finished beverage may be dispensed by separately dispensing a food acid concentrate components of the diet-cola finished beverage, food acid-degradable concentrate components of the diet-cola finished beverage, micro-ingredient sweetener, such as aspartame or an aspartame blend, and carbonated water. As a further example, a mid-calorie micro-ingredient-based cola finished beverage may be dispensed by separately dispensing a food acid concentrate components of the mid-calorie cola finished beverage, food acid-degradable concentrate components of the mid-calorie cola finished beverage, a reduced amount of a macro-ingredient sweetener, a reduced amount of a micro-ingredient sweetener, and carbonated water. By reduced amount of macro-ingredient and micro-ingredient sweeteners, it is meant to be in comparison with the amount of macro-ingredient or micro-ingredient sweetener used in the cola finished beverage and diet-cola finished beverage. As a final example, a supplementally flavored micro-ingredient-based beverage, such as a cherry cola beverage or a cola beverage with an orange flavor shot, may be dispensed by separately dispensing a food acid concentrate components of the flavored cola finished beverage, food acid-degradable concentrate components of the flavored cola finished beverage, one or more non-sweetener micro-ingredient flavor additives (dispensed as either as a recipe-based flavor version of a finished beverage or a flavor shot), a sweetener (macro-ingredient sweetener, micro-ingredient sweetener, or combinations thereof), and carbonated water. While the above examples are provided for carbonated beverages, the principles may apply to still beverages as well by substituting carbonated water with plain water.

The various ingredients may be dispensed by the beverage dispenser 100 in a continuous pour mode where the appropriate ingredients in the appropriate proportions (e.g., in a predetermined ratio) for a given flow rate of the beverage being dispensed. In other words, as opposed to a conventional batch operation where a predetermined amount of ingredients are combined, the beverage dispenser 100 provides for continuous mixing and flows in the correct ratio of ingredients for a pour of any volume. This continuous mix and flow method may also be applied to the dispensing of a particular size beverage selected by the selection of a beverage size button by setting a predetermined dispensing time for each size of beverage.

Figure 2A:
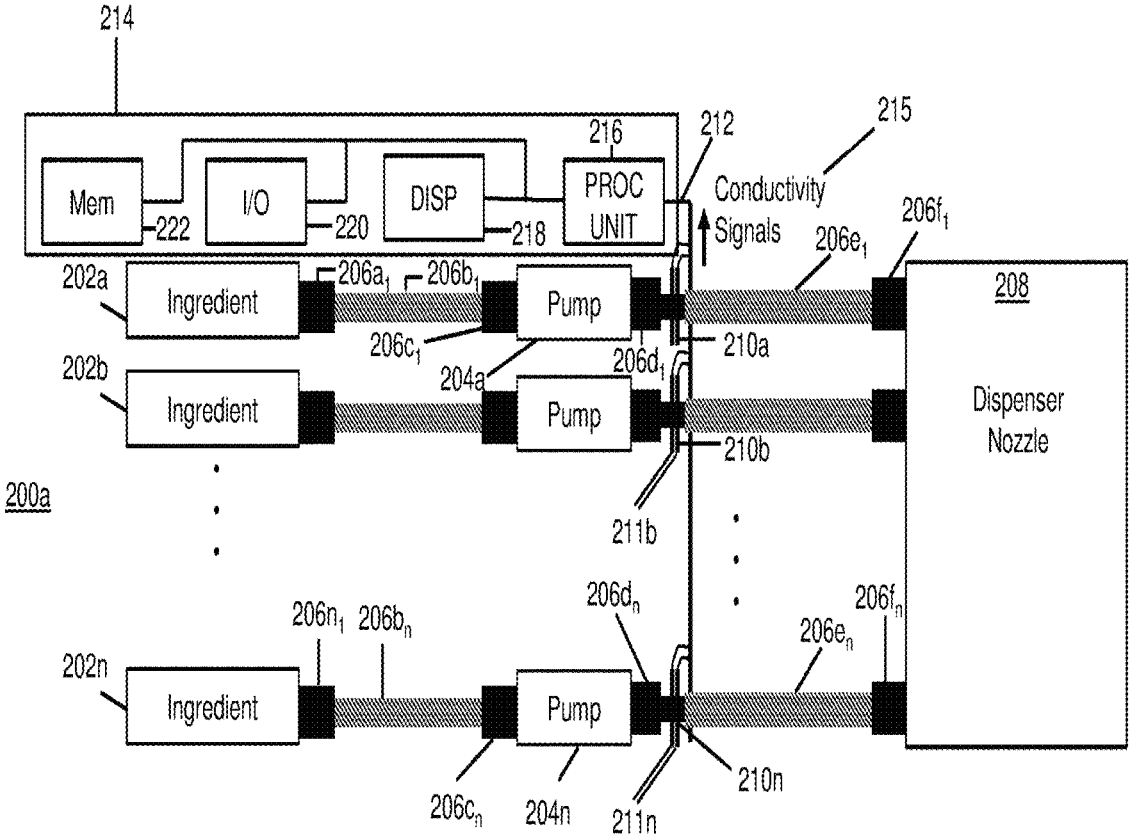
FIGS. 2A-2C are illustrations of illustrative ingredient processing devices for producing beverages by a dispenser.
Figure 2B:
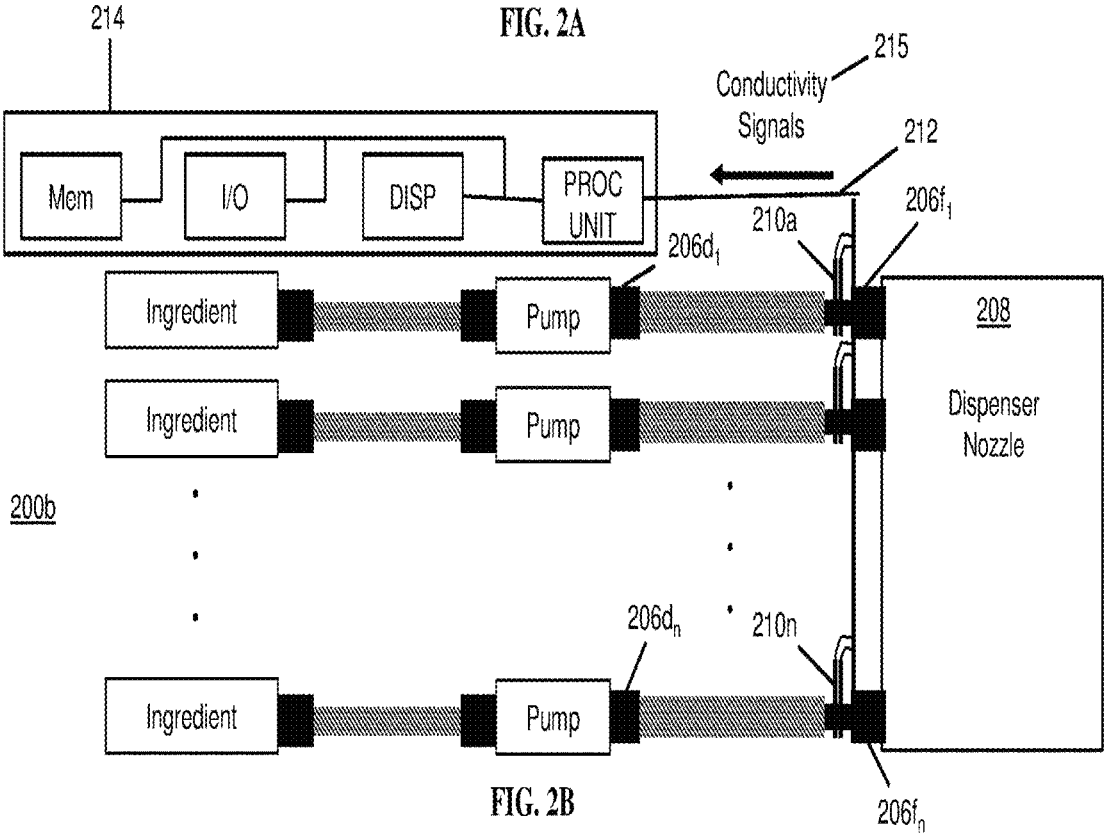
Figure 2C:
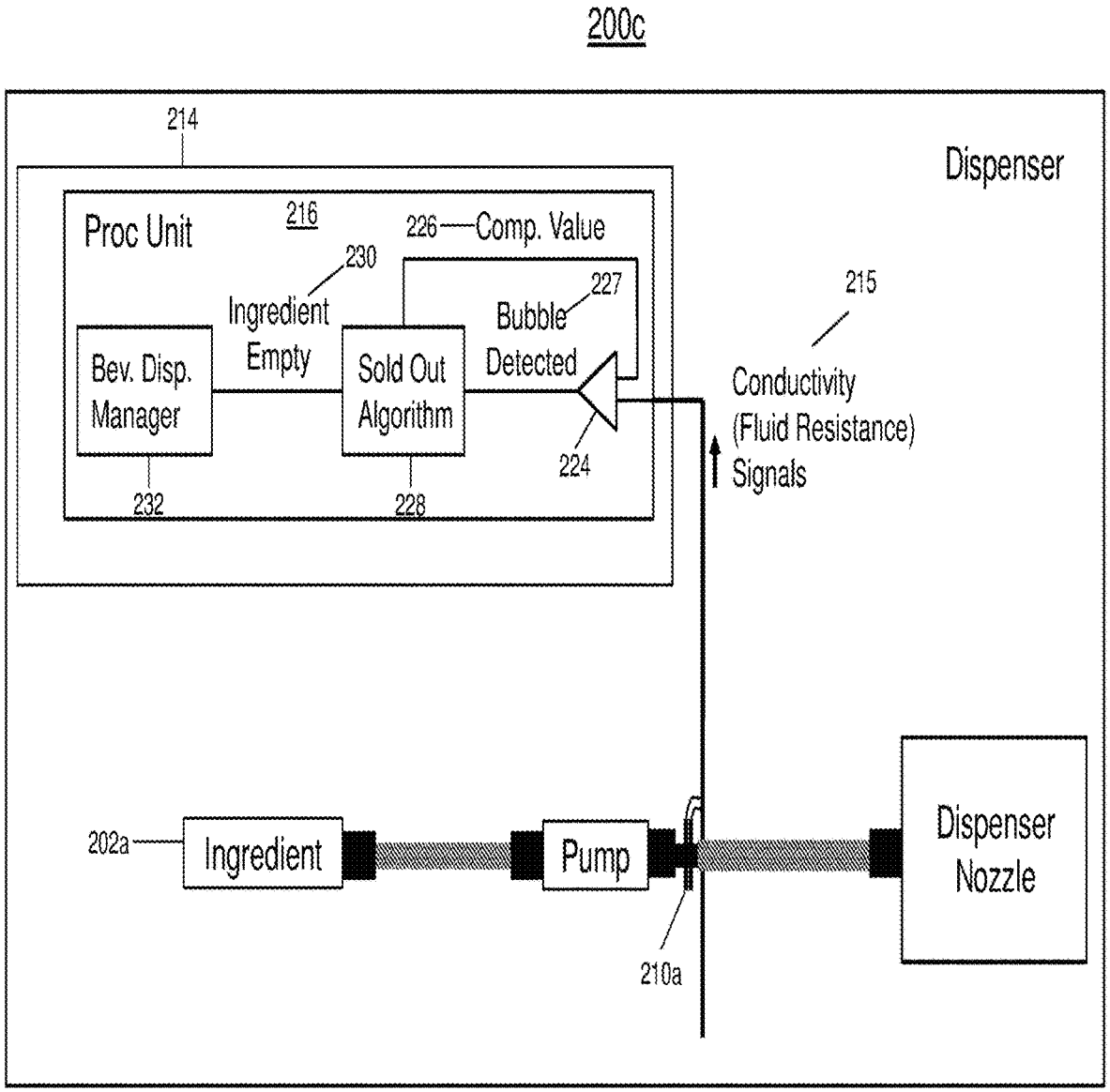

With regard to FIGS. 2A-2C, illustrations of illustrative ingredient processing devices for producing beverages by a dispenser are shown. As provided in FIG. 2A, dispensers 200*a*-200*c* may include or be in communication with storage containers 202*a*-202*n* (collectively 202) may be used to store ingredients for producing beverages. The ingredients may be flavors, acid, sweeteners, syrups, or any other ingredient for producing a beverage from a beverage dispenser, as previously described. The storage containers 202 may be disposable or reusable, as understood in the art. The beverage containers may be the same or different sizes depending upon a type of ingredient stored within each of the respective storage containers 202. For example, a micro ingredient, which may use at a high ratio, may be stored in a half-liter container, for example, while a macro ingredient, which may be used at a low ratio to produce a beverage, may be stored in a 3 liter or 3 gallon container, for example.

Pumps 204*a*-204*n* (collectively 204) may be used to hydraulically move the fluid ingredients. Rather than using conventional pumps with automatic feedback control, such as pressure sensing feedback control, one embodiment of the pumps 204 may utilize a positive displacement pump that moves a certain amount based on input without regard to feedback, as understood in the art. Example positive placement pumps may include piston pumps, nutating pumps, diaphragm pumps, etc. As an example, the pumps 204 may be responsive to input control signals to pump a certain amount of fluid within the fluid paths 206 that is predetermined to output a certain amount of ingredient, thereby reducing complexity of the pumps 204 and controller (e.g., processor) such that the pumps 204 may be less expensive than conventional pumps that utilize automatic feedback control. To estimate remaining ingredient amounts, the dispenser may count how many ingredient dispenses has occurred, which indicates how much fluid ingredient has been dispensed, thereby providing a good estimate of remaining beverage ingredient. However, because amount of ingredient may vary in each container because of air within a storage container, for example, an empty ingredient sensor is used to further resolve empty status of a beverage ingredient.

Extending from the storage containers 202 may include adapters or connectors 206$a_1$-206$a_n$ (collectively 206*a*), which connect to a conduits 206*b*1-206$b_n$ (collectively 206*b*), adapters 206$c_1$-206$c_n$ (collectively 206*c*), adapters 206$d_1$-206$d_n$ (collectively 206*d*), conduits 206$e_1$-206$e_n$, (collectively 206*e*) and adapters 206$f_1$-206$f_n$ (collectively 206*f*), which collectively form a set of fluid paths (collectively 206). The fluid paths 206 enable fluid ingredients to flow from the storage containers 202 via the pumps 204 to a dispenser nozzle 208. It should be understood that the configuration of the fluid paths 206 is illustrative, and that alternative configurations may be utilized.

In an embodiment, conductivity sensors 210*a*-210*n* (collectively 210) may extend into a portion of the respective fluid paths 206. In an embodiment, connectors 206*d* may have a pair of conductors 211*a*-211*n* (collectively 211) that form the conductivity sensors 210 integrated therewith. The conductors 211 of the conductivity sensors 210 may extend into or through the connectors 206*d* into a fluid path or conduit, such that when fluid exists within the conduit of the connectors 206*d*, electrical conductivity of respective fluid ingredients may be measured. The conductivity sensors 210 may be in electrical communication with a data bus 212 that is configured to communicate electrical and/or data signals to electronics 214 of the dispenser. The conductivity sensors 210 may be configured to collect and communicate conductivity signals 215, which may be analog signals or digital signals, along the data bus 212 to the electronics 214.

The electronics 214 may include a processing unit 216, electronic display 218, input/output (I/O) unit 220, and memory 222. The processing unit 216 may be formed of integrated electronics, such as a microprocessor and electronics that support the microprocessor, and be configured to process data, such as, conductivity signals 215 or data derived therefrom, to control operation of the dispenser based on level (e.g., fluid ingredient available or empty) of the ingredients. The processing unit 216 may be in communication with each of the electronic display 218, input/output unit 220, and memory 222 for processing and presenting (i) levels of ingredients and (ii) sensed empty conditions of ingredients by the conductivity sensors 210. The electronic display 218 may be a touch-sensitive electronic display, as understood in the art. The I/O unit 220 may be configured to communicate over wireless (e.g., WiFi®, Bluetooth®, cellular, etc.) and/or wireline (e.g., Internet) communications networks to remote electronic devices (e.g., mobile devices, network server). The memory 222 may be configured to store information associated with each of the ingredients, such as ingredient type, ingredient container capacity, last date replaced, remaining amount, electrical conductivity and/or other measurement parameter, and so on.

In an embodiment, the processing unit 216 may store measured or estimated levels of ingredients available to be dispensed based on an amount of time that the pumps are turned on. The processing units 216 may also be configured to receive electrical conductivity signals from the conductivity sensors 210 to confirm that estimates are accurate, and, in response to receiving a conductivity signal that indicates that air has entered into a portion of the fluid path that the conductivity sensor is sensing, cause the dispenser to stop during or after, dispensing and enabling selection of a beverage including the ingredient that is detected to be empty. Because electrical conductivity is being sensed, fewer false positives are created than those generated using optical or other sensing techniques. As an example, if a small air bubble is sensed, the electrical conductivity may not change in a statistical enough manner (e.g., less than a predetermined standard deviation) to indicate that the ingredient is empty. In an embodiment, the processing unit 216 may disable one or more selectable icons of a beverage that includes the beverage ingredient that has been sensed to be empty by way of a conductivity measurement crossing a threshold level.

In an embodiment, in the event that a detection of the beverage ingredient being empty during a user pouring a beverage, the dispenser may disable further dispensing, present a notification to the user of the status of the beverage ingredient, disable selection of beverages with the empty beverage ingredient, and recommend that the user select a new beverage. The threshold level may be defined based on sensed electrical conductivity levels for ingredient fluid, and should be set to distinguish between small air bubbles and air bubbles that are indicative of empty fluid ingredient levels. It should be understood that the conductivity sensors may alternatively be configured to sense different electrical or other dynamic parameters, as further described herein.

With regard to FIG. 2B, rather than the conductivity sensors 210 being integrated with the connectors 206*d*, the conductivity sensors 210 are integrated into the connectors 206*f*. By placing the conductivity sensors 210 closer to the dispenser nozzle 208, more ingredient may be dispensed into beverages than if the conductivity sensors 210 are integrated into the connectors 206*d* (i.e., ingredient amounts that exist along the conduits within connectors 206*d* and conduits 206*e*). Dispensing more ingredient may reduce ingredient credits (i.e., credits to a food outlet or dispenser operator for unused ingredient amounts in a beverage ingredient container), increase productivity for operators as the number of dispensed beverages may be increased by not sensing an actual empty condition in the fluid paths 206 until the air is about to be dispensed via the dispenser nozzle 208, and increase customer satisfaction because beverage satisfaction is higher (i.e., fewer pours with inaccurate ingredients). In an embodiment, the sensors 210 may be positioned far enough away from the nozzle 208 to ensure a beverage currently being dispensed when an empty fluid ingredient is detected by the sensor receives a full amount of the ingredient. In another embodiment, multiple conductivity sensors 210 may be disposed along the fluid paths 206 to enable the processing unit 216 to correlate electrical conductivity readings of the sensors 210 in a fluid path, thereby reducing false positives even further.

Still yet, in addition to using sensors 210 downstream of the pumps 204, the sensors 210 may be disposed upstream of the pumps 204. For example, the sensors 210 may be disposed at outputs of the storage containers (ingredient packages) 202, such as within adapters 206*a*. By detecting air in fluid paths prior to reaching the pumps 204, reduced incidences of having to prime the fluid paths downstream of the pumps 204 when packages are emptied result.

With regard to FIG. 2C, the conductivity sensor 210*a* may communicate the conductivity (fluid resistance) signals to the electronics 214 for processing. As shown, the processing unit 214 may include a comparator 224, which may be hardware or software, that compares the conductivity signals 215 with a comparator value 226. The comparator value 226 may be set at a threshold level that allows for small air bubbles to pass without reaction, but identifies air bubbles that are large enough to indicate that the ingredient 202*a* is empty. The comparator 224 may generate an output 227 that indicates if an air bubble detected is greater than the comparison value 226. A sold out algorithm 228 may be configured to handle a situation in which an ingredient is sold out, as indicated by the output 227. The algorithm 228 may determine whether the size of the air bubble is of a certain size based on am amount of time that the output 227 is turned on for a minimum length of time. In an alternative embodiment, the algorithm 228 may determine whether a certain number of air bubbles are detected over a time duration. In an embodiment, the algorithm 228 may communicate an ingredient empty signal or message 230 to a beverage dispenser manager 232 that is configured to prevent further dispensing and/or display of beverages that include an empty ingredient, such as ingredient 202*a* if determined to be empty by measuring the size of air bubbles in a fluid conduit, as previously described.

Figure 3A:
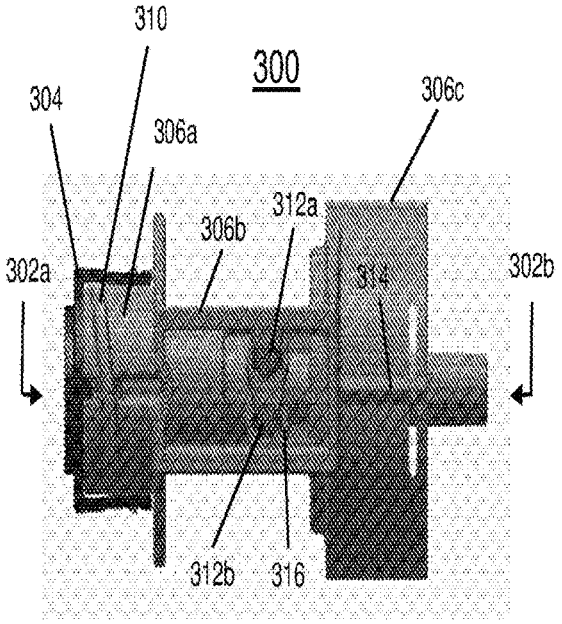
FIGS. 3A-3C are illustrations of an illustrative fluid path connector inclusive of a conduit and electrical conductivity sensor.
Figure 3B:
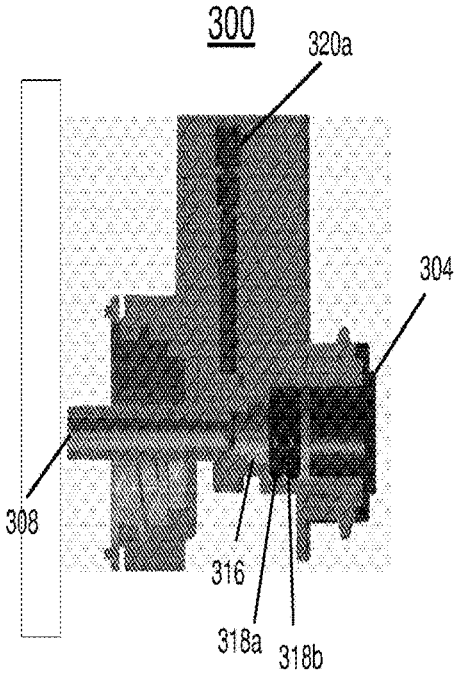
Figure 3C:
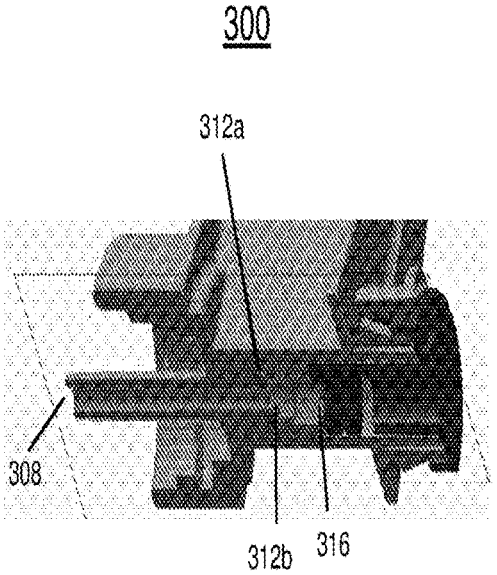

With regard to FIGS. 3A-3C, illustrations of an illustrative fluid path connector 300 inclusive of a conduit and electrical conductivity sensor is shown. As shown in FIG. 3A, the fluid path connector 300 defines a first opening 302*a* and second opening 302*b* (collectively 302). An adapter member 304 may be used to provide a seal that is attached to a first structural portion 306*a* of the connector 300 when the connector 300 is connected into a pump or other device. The connector 300 may further include a second structural portion 306*b* and a third structural portion 306*c*. The first, second, and third structural portions 306*a*-306*c* (collectively 306) may provide for a housing through which a conduit 308 extends. The conduit 308 may have different dimensions throughout the connector 300, as further described herein. The first structural portion 306*a* may be used to form a thread 310 or other structural feature(s) that may be used to engage and retain the connector 300 to a pump or other mechanism.

To sense electrical conductivity of fluid that may pass through the conduit 308, electrical conductors 312*a* and 312*b* (collectively 312) may enter into a structural member 314 that defines a cavity 316. The electrical conductors 312 may be formed of duplex stainless steel or other material that avoids corrosion when exposed to fluids that have high or low pH and high sodium content, such as those found in beverage ingredients. The electrical conductors 312 may be flush to a sidewall, extend into, or extend through the cavity 316, such as shown in FIGS. 2A and 2B. In an embodiment, the conductors 312 may extend in parallel into the cavity 316 via the structural member 314. Alternatively, the electrical conductors 312 may be disposed in opposing directions in a linear manner across the cavity 316 from one another. The conductors may be spaced within a few millimeters. Alternative spacing, such as a few inches, may be used depending on the radius of the conduit, configuration of the connector, fluid type, or otherwise. In an embodiment, the conductors 312 may be positioned at a bottom, top, or middle of the cavity 316 or conduit 308 to be more or less sensitive to air bubbles that are not indicative of an empty ingredient condition that enter into the fluid path or the ingredients.

In operation, the electrical conductors may be configured with one conductor 312*a* with a positive charge and the other conductor 312*b* with zero charge (ground) so as to sense electrical conductivity of fluid ingredient that passes through the cavity 316 and into the conduit 308. The conductivity of the fluid ingredient may be measured using a resistance measurement, as understood in the art. In performing the conductivity measurement, the electrical conductivity signal may have a discontinuity in the event that an air bubble or pocket that represents an empty ingredient condition passes past the electrical conductors 312. That is, when a fluid ingredient (i.e., conductive medium) is absent, conductivity drops or stops completely between the conductors 312. It should be understood that the electrical conductivity measurements may be different depending on size of an air bubble or air pocket, where small air bubbles may not indicate that the ingredient container is empty and an air pocket (large air bubble) indicates that the ingredient container is empty. In an embodiment, a pair of gaskets 318*a* and 318*b* (collectively 318) may be used to seal the cavity 316 to prevent ingredient fluid from leaking from the connector 300.

In an embodiment, and electrical connectors 320 may extend through the structural portion 306*b* and physically contact the respective electrical conductors 312*a* and 312*b*. The electrical connectors 320 may be used to conduct electrical conductivity readings from the fluid to a processing unit for processing thereat. The connectors 320 may alternatively contact the conductors 312 outside of the connector 300.

Figure 4A:
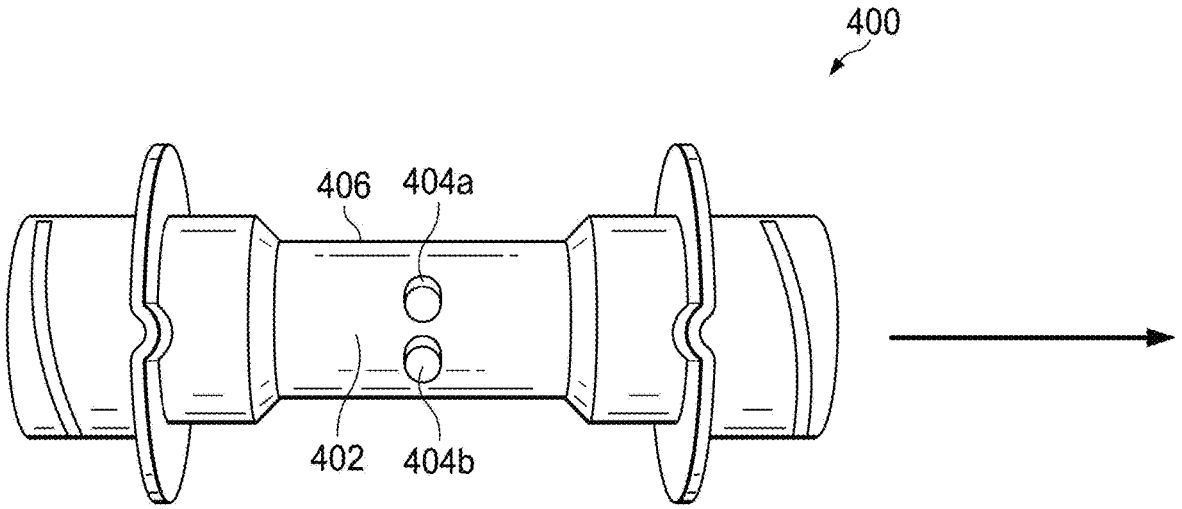
FIGS. 4A and 4B are illustrations of an illustrative fluid connector that defines a conduit through which a fluid ingredient may flow.
Figure 4B:
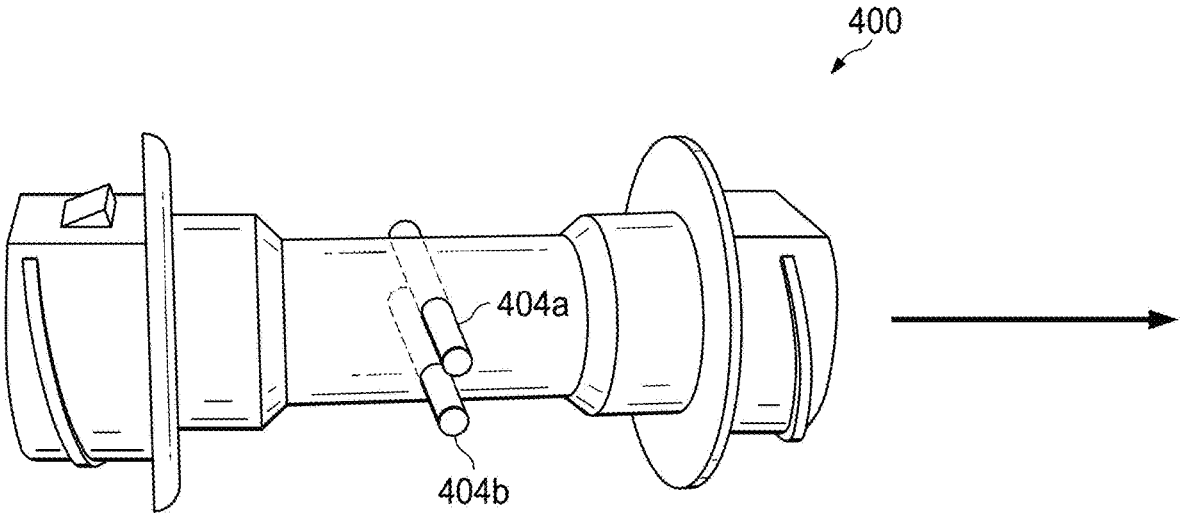

With regard to FIGS. 4A and 4B, illustrations of an illustrative fluid connector 400 that defines a conduit 402 through which a fluid ingredient may flow is shown. A pair of electrical conductors 404*a* and 404*b* (collectively 404) are shown to extend through a sidewall 406 and into the conduit 402. As previously described, electrical conductivity measurements may be measured using the electrical conductors 404 within fluid ingredients that pass through the conduit 402. As an air bubble passes between the conductors 404, a discontinuity measurement may be made, thereby indicating that air has entered the conduit 402, which may signify that a fluid ingredient is running low or empty depending on a value of the electrical conductivity level of the fluid ingredient.

Figure 5:
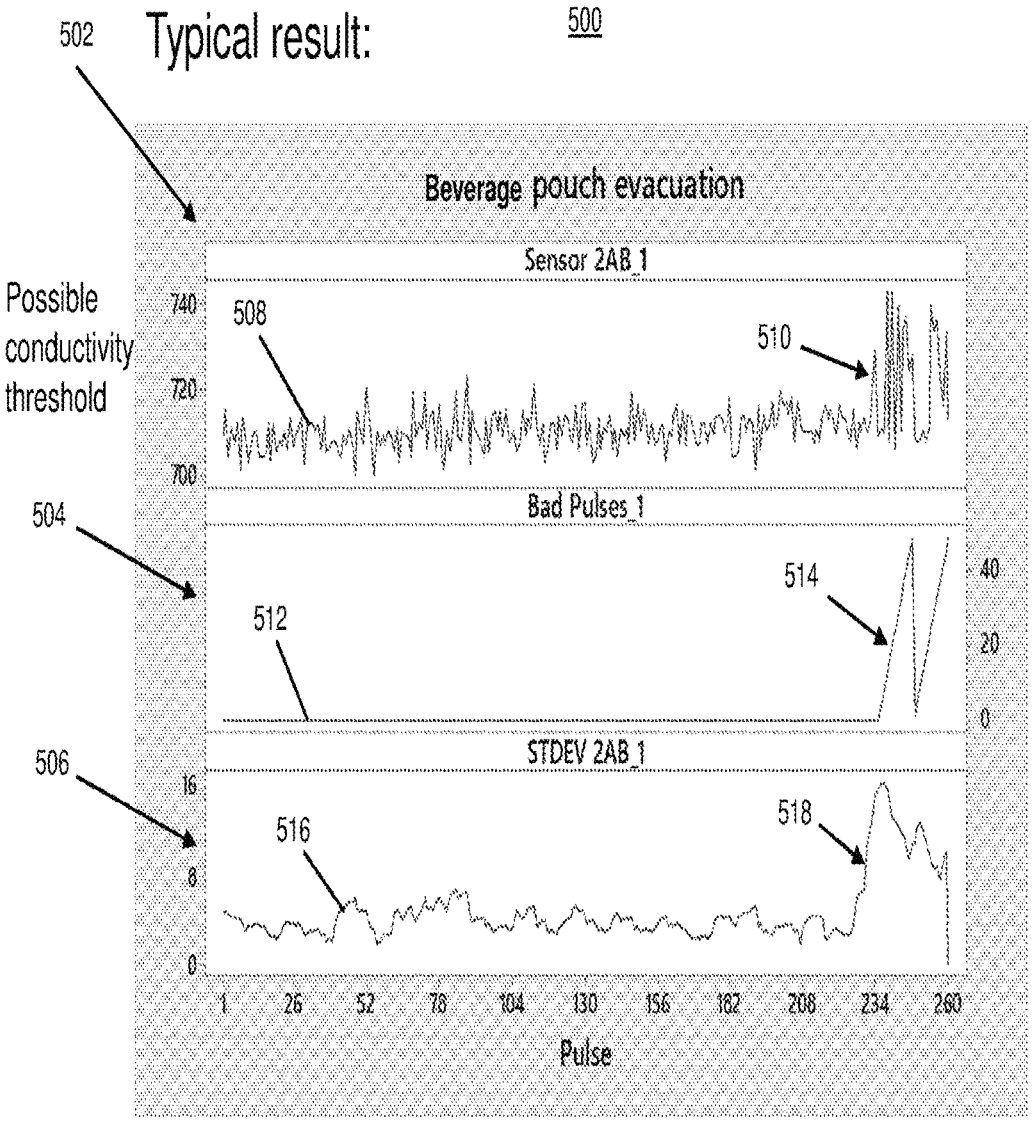
FIG. 5 includes three illustrative graphs to respectively represent conductivity measurements, bad pulses, and standard deviation in response to sensing air within a conduit, thereby representing a beverage pouch evacuation.

With regard to FIG. 5, three illustrative graphs 502, 504, and 506 are shown to respectively represent conductivity measurements, bad pulses, and standard deviation in response to sensing air within a conduit, thereby representing a beverage pouch evacuation. Graph 502 shows raw conductivity measurements 508 over time of a fluid ingredient measured using a conductivity sensor, such as previously described. Toward the right side of the graph 502, a spike 510 in the conductivity measurements 508 is shown as a result of air bubble(s) being sensed by the conductivity sensor. Graph 504 shows a resulting plot 512 of pulses 514 that are indicative of an air bubble indicative of an empty fluid ingredient condition being detected. The pulses 514 may be indicative that an air bubble is sufficiently large to indicate that a beverage ingredient is empty or nearly empty.

Graph 506 presents a standard deviation curve 516 of the conductivity measurements 508 to quantify an amount of variation over the conductivity measurements. As shown, a significant increase 518 of the standard deviation occurs in response to a determination that an air bubble is measured by the conductivity sensor. The standard deviation may vary depending on the size of the air bubble or air pocket. In an embodiment, a standard deviation threshold value may be set that distinguishes a small air bubble and an air bubble that is indicative of the fluid ingredient being empty. Alternative threshold level metrics may be utilized to identify when a fluid ingredient is empty, including a threshold conductivity level. It should be understood that although the principles described herein use conductivity as a measure, that any other parameter that may be derived using resistance or other electrical measurement of air within a fluid using electrical conductors are contemplated.

Figure 6:
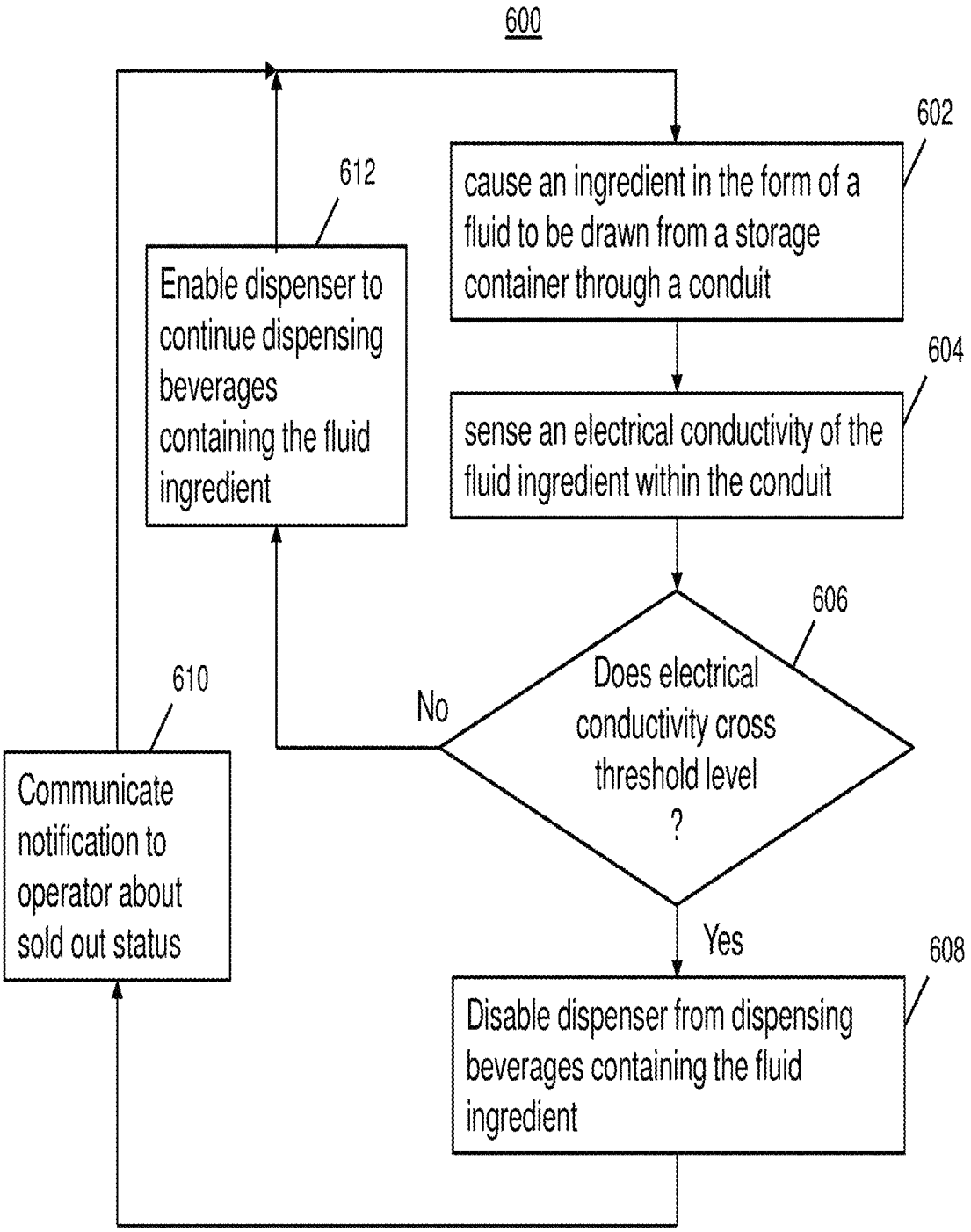
FIG. 6 is a flow diagram of an illustrative process for operating a beverage dispenser.

With regard to FIG. 6, a flow diagram of an illustrative process 600 for operating a beverage dispenser is shown. The process 600 may start at step 602, where an ingredient in the form of a fluid may be caused to be drawn from a storage container through a conduit. At step 604, an electrical conductivity of the fluid ingredient may be sensed within the conduit. A determination as to whether an electrical conductivity of the fluid crosses a threshold level at step 606. The determination may be made based on whether the electrical conductivity or metric derived therefrom (e.g., standard deviation) has crossed a threshold level indicative of a fluid ingredient being empty. If the determination indicates that the fluid ingredient is empty, then at step 608, the dispenser may disable dispensing beverages containing the fluid ingredient. In disabling dispensing beverages, the dispenser may "grey out" or otherwise disable one or more beverage icons displayed on a user interface that includes any of the empty fluid ingredients. Moreover, in addition to disabling icon(s) from being selectable by the user, the dispenser may physically disable dispensing any beverages that include the empty fluid ingredient(s). At step 610, the dispenser may optionally communicate a notification to the operator about the "sold out" or empty status of the fluid ingredient. The optional notification may be in a variety of electronic communication forms, including SMS text messaging, email, posting to a mobile app or other user interface to a dispenser management system operating on a network server that the dispenser operator may operate or access, or otherwise. Otherwise, if the determination is indicative that the fluid ingredient is not empty at step 606, then at step 612, the dispenser may be enabled to continue dispensing beverages containing the fluid ingredient. If the dispenser is currently enabled to dispense beverages containing the fluid ingredient, then no change is to occur. The process 600 may repeat dispensing and sensing for the fluid ingredient becoming empty.

In an embodiment, sensing the electrical conductivity of the fluid ingredient may include sensing the electrical conductivity of the fluid ingredient on a dispenser side of a pump configured to pump the fluid ingredient from the storage container to and output of the conduit to be mixed with another beverage fluid. Sensing an electrical conductivity may include sensing using a pair of electrodes that extend into the conduit. The pair of electrodes may be in parallel with one another, and be positioned within a connector. Disabling the dispenser from dispensing a beverage with the fluid ingredient may include preventing a user from being able to select a beverage that includes the ingredient via a user interface. A notification message may be communicated to an operator of the dispenser that the fluid ingredient is sold out in response to determining that the fluid ingredient is empty. The fluid ingredient may be a micro fluid ingredient. Sensing the electrical conductivity of the fluid ingredient within the conduit may include sensing electrical conductivity in a conduit external from a pump. The sensing may include sensing an electrical conductivity of each fluid ingredient in respective conduits configured to transport the fluid ingredients. Based on the measurements, a processor may be configured to control operation of the dispenser (e.g., disable dispensing beverages that include an ingredient that is empty). The processor may further be configured to generate and communicate a notification to an electronic device of an operator in response to sensing that a fluid ingredient is empty based on an electrical conductivity measurement.

Although the preceding measurement techniques provide for low error rate with low cost and high reliability, alternative sensing techniques may be utilized. Such techniques may include the following:

In-line pressure gauge: an in-line pressure gauge may be used to detect a drop in pressure when an ingredient container, such as a pouch, is empty and collapses so as to indicate that the ingredient is empty;

Accelerometer: an accelerometer may be connected to a fluid path to measure movement when fluid ingredient is pumping through the fluid path, where if no motion is detected when a pump is activated, then a determination may be made that the ingredient is empty;

Weight sensor: a weight sensor or scale may be used to sense a change in weight of an ingredient container or other fluid path member that, when a weight of the container or fluid path member crosses a weight level, indicates that the ingredient is empty;

Vibration frequency detector: a vibration frequency detector may be configured to measure vibration of a pump or other fluid path member that, when a frequency indicative of pumping a fluid changes, is indicative that the ingredient is empty;

Rotameter: a rotameter may be configured to measure flow rate of fluid in a fluid path, that may be used to determine when an fluid ingredient flow slows or stops so as to indicate that the ingredient is empty;

Optical (color): an optical sensor may be configured to sense when a color of a fluid path changes (e.g., measured from first side, such as a bottom, of a fluid path via a clear window or otherwise against a clear window on an opposing side, such as a top, of the fluid path with a white light illuminating the clear window), that, when the color changes, is indicative that the fluid is empty;

Diaphragm pressure switch: a diaphragm pressure, which is a flexible seal, may be configured to measure low pressure within a fluid ingredient path, which when flexes closed, is indicative that the ingredient is empty;

Venturi flow meter: a Venturi flow meter may be configured to sense flow rate of fluid ingredient through a Venturi tube, which has a reduced cross-section, that, when reduces below a threshold flow rate, is indicative that the ingredient is empty;

RF: an RF sensor may be configured to sense that a fluid ingredient has slowed or stopped by a changed (e.g., increase) of RF energy being sensed within a fluid path, thereby being indicative that the ingredient is empty;

Paddle wheel flow meter: a paddle wheel flow meter may be positioned within a fluid path of a fluid ingredient and a slowing or stopping of the paddle wheel flow meter is indicative of the ingredient being empty; and Heat flow: a heat sensor may be used to measure temperature within a fluid path such that when a temperature changes, an indication that air has replaced the fluid and the fluid is empty.

A variety of the sensors described above and others not described, but capable of providing the same or similar functionality, may use visual sensing or have a need for less electrically or electromagnetically obstructive access than a material formed of a non-conductive material. As such, one or more of the ingredient containers (e.g., pouches), chasses, cartridge trays, conduits, and so forth may be transparent and/or have electrically or electromagnetic conductive material that enables sensing of fluid level, flow rate, or otherwise.

In addition to or as an alternative to using the sensors provided above, level sensors may be used in the fluid path of liquid ingredients. As part of a level sensor configuration, appropriate controls may be used to control the liquid ingredient in the fluid path, as further described herein.

Figure 7:
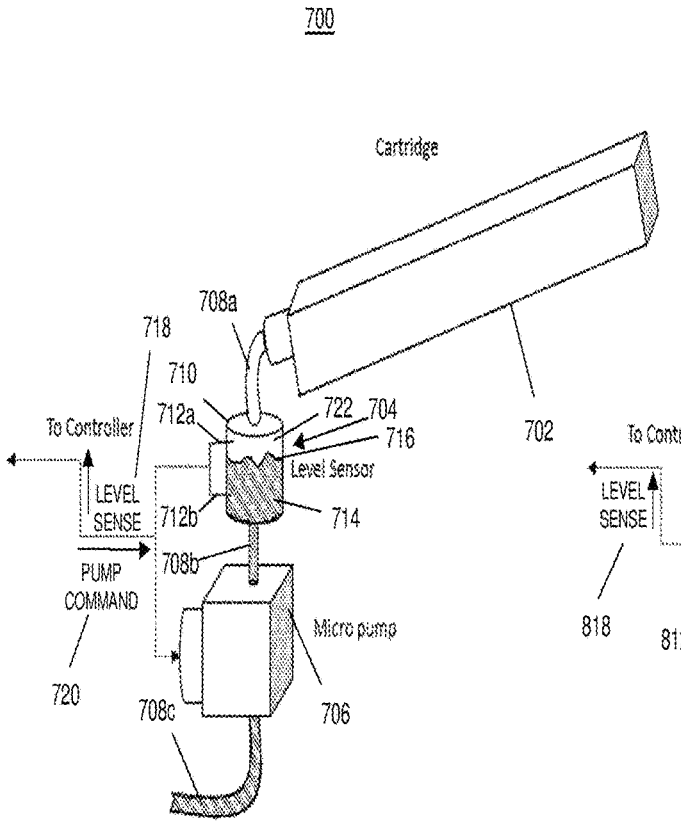
FIG. 7 is an illustration of an illustrative portion of a beverage dispenser inclusive of an empty ingredient cartridge along with a level sensor used to sense whether the ingredient cartridge is empty to enable a controller to cause a micro-pump to stop or prevent pumping.

With regard to FIG. 7, an illustration of an illustrative portion of a beverage dispenser 700 inclusive of an empty ingredient cartridge 702 along with a level sensor 704 used to sense whether the ingredient cartridge 700 is empty to enable a controller (not shown) to cause a micro-pump 706 to stop or prevent pumping is shown. By stopping or preventing further pumping, beverages that are out of spec due to incorrect ingredient levels may be avoided from being poured. The cartridge 702 and level sensor 704 may be fluidly connected by a conduit 708*a*, and the level sensor 704 may be fluidly connected to the micro-pump 706 via conduit 708*b*. The micro-pump 706 may be fluidly connected to a nozzle (not shown) or other element of the beverage dispenser via conduit 708*c*. As shown, the level sensor 704 includes a reservoir 710 along with sensor electrodes 712*a* and 712*b* that may be used to determine level of fluid 714 contained therein. The fluid 714 is shown to have a maximum level defined by a top surface 716 of the fluid 714.

In operation, the electrodes 712 may be used to determine when the top surface 716 of the fluid 714 is below the electrode 712*a* and above the electrode 712*b*. When the top surface 716 of the fluid 714 is between the electrodes 712*a* and 712*b*, an open circuit (or other electrical characteristic that can be sensed) between the two electrodes 712 is created, and a level sensor signal 718 indicative thereof may be communicated to a controller (not shown). By using the level sensor 704 with a reservoir 710, there is less of a chance of a small air bubble inadvertently causing a false low level sense signal to be generated than other sensing configurations. In response, the controller may generate a pump command 720 to instruct the micro-pump 706 to stop pumping or prevent further pumping as a result of the fluid 714 being low, which indicates that the ingredient cartridge 702 is empty. In one embodiment, the ingredient cartridge 702 is a micro-ingredient cartridge that stores a micro-ingredient, as previously described. The level sensor 704 detects level of the ingredient being low as a result of air 722 filling within the reservoir 710 above the fluid 714.

During a dispensing operation of a beverage, in response to the controller detecting that an ingredient is empty via the level sensor 704, the pump command 720 instructs the micro-pump 706 (*i*) to rotate a certain number of turns, (ii) for a certain period of time, (iii) for a certain fluid distance, or (iv) otherwise, based on a determination of how much fluid remains in the conduits 708*b* and 708*c* (e.g., based on the fluid path dimensions from the pump 706 to the nozzle) to continue delivering fluid 714 or micro-ingredient to a nozzle for producing a beverage. For example, after sensing that the fluid 714 is low by the level sensor 704, a certain amount of time or number of rotations of the micro-pump 706 that the micro-pump 706 may be operated may be determined (or simply looked up in a non-transitory memory by a processing unit) to avoid air exiting a nozzle. Of course, to avoid pouring an undesirable drink (i.e., a drink with an incorrect amount of ingredients), the amount of time or number of turns the micro-pump 706 is to operate should be conservative based on amount of fluid in the conduit path (i.e., conduits 708*b* and 708*c*) and size (or maximum size if size is unknown) of the beverage being poured. Alternatively, in response to the level sensor 704 detecting that the level of the fluid 714 is low (i.e., when the top surface 716 is sensed between the electrodes 712), the controller may prevent further operation of the micro-pump 706 entirely.

Figure 8:
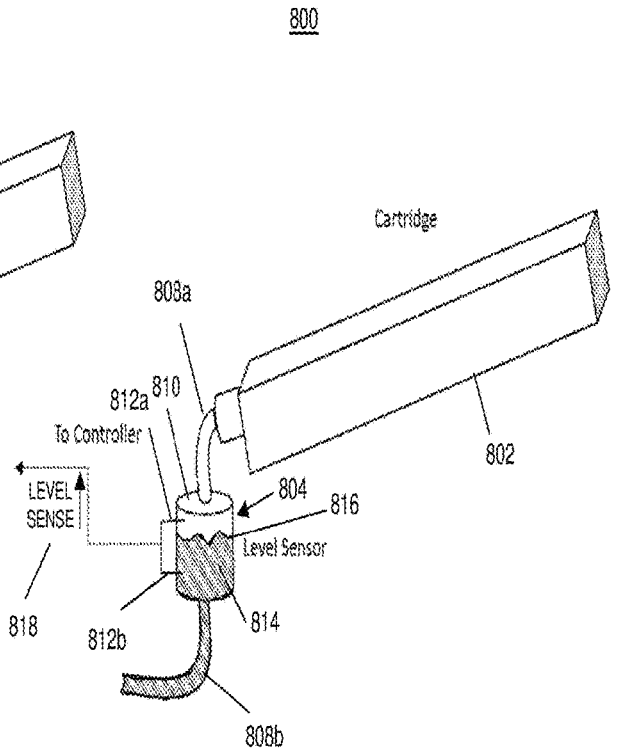
FIG. 8 is an illustration of an alternative embodiment of the portion of the beverage dispenser of FIG. 7, and provides for an illustrative empty ingredient cartridge along with a level sensor used to sense whether the ingredient cartridge is empty, but does not include a micro-pump.

With regard to FIG. 8, an illustration of an alternative embodiment of the portion of the beverage dispenser of FIG. 7 that also provides for an illustrative empty ingredient cartridge 802 along with a level sensor 804 used to sense whether the ingredient cartridge 802 is empty, but does not include a micro-pump, such as micro-pump 706 of FIG. 7, is shown. In this embodiment, conduits 808*a* and 808*b* are fluidly connected with the cartridge 802 and extends to a valve or nozzle (not shown). Electrodes 812*a* and 812*b* may be used to sense ingredient fluid 814 using electrodes 812*a* and 812*b* in the same or similar manner as provided in FIG. 7. In this case, however, since no micro-pump or other pump is included as part of controlling the ingredient fluid 814 based on a top surface 816 of the fluid 814 in the reservoir 810, the controller may control an electronically controlled valve (not shown) or other control mechanism that may prevent the ingredient fluid 814 from further being dispensed to produce beverages.

Figure 9A:
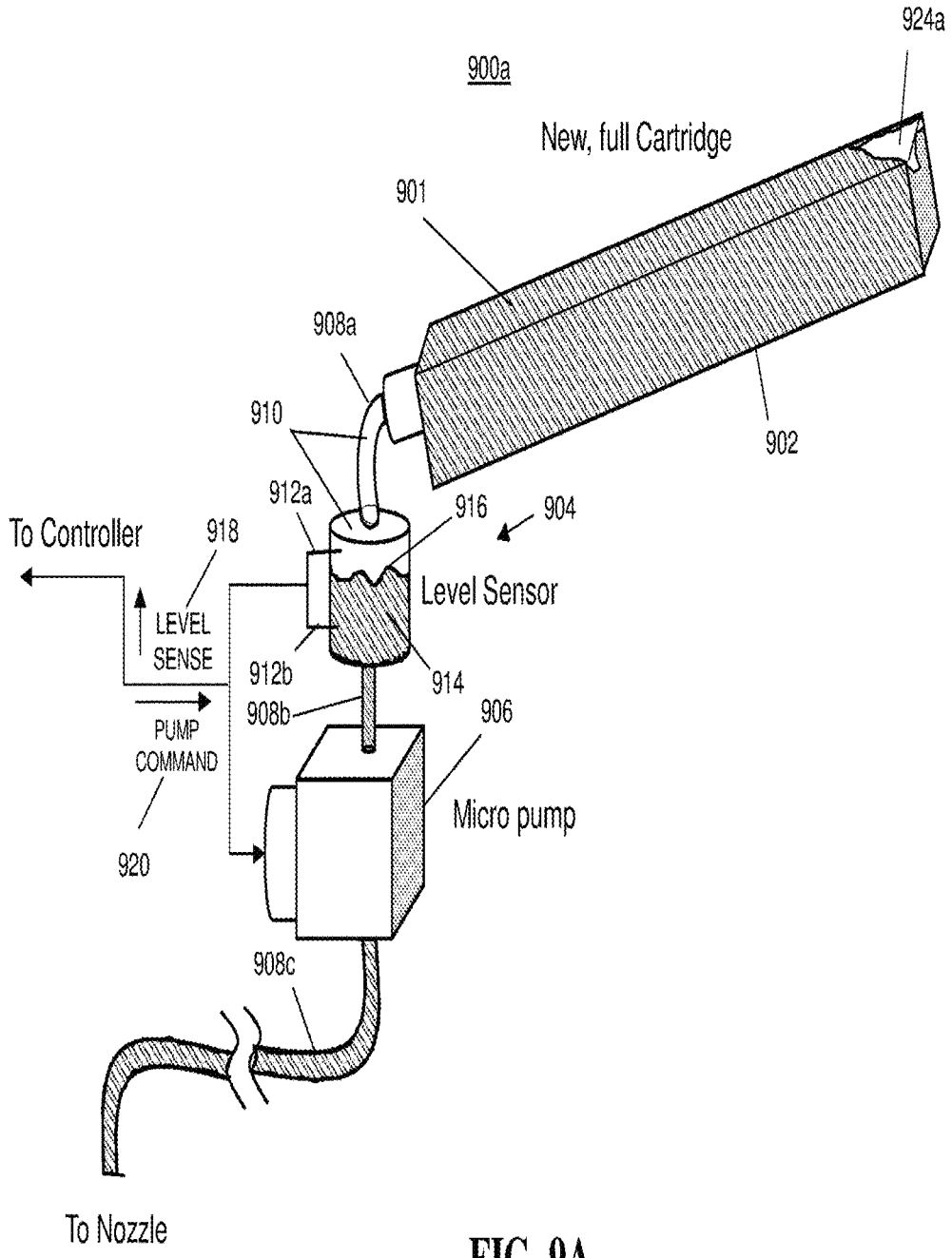
FIG. 9A is an illustration of an illustrative portion of a beverage dispenser inclusive a new ingredient cartridge along with a level sensor, micro-pump, and conduit that connects to a nozzle of a dispenser.
Figure 9B:
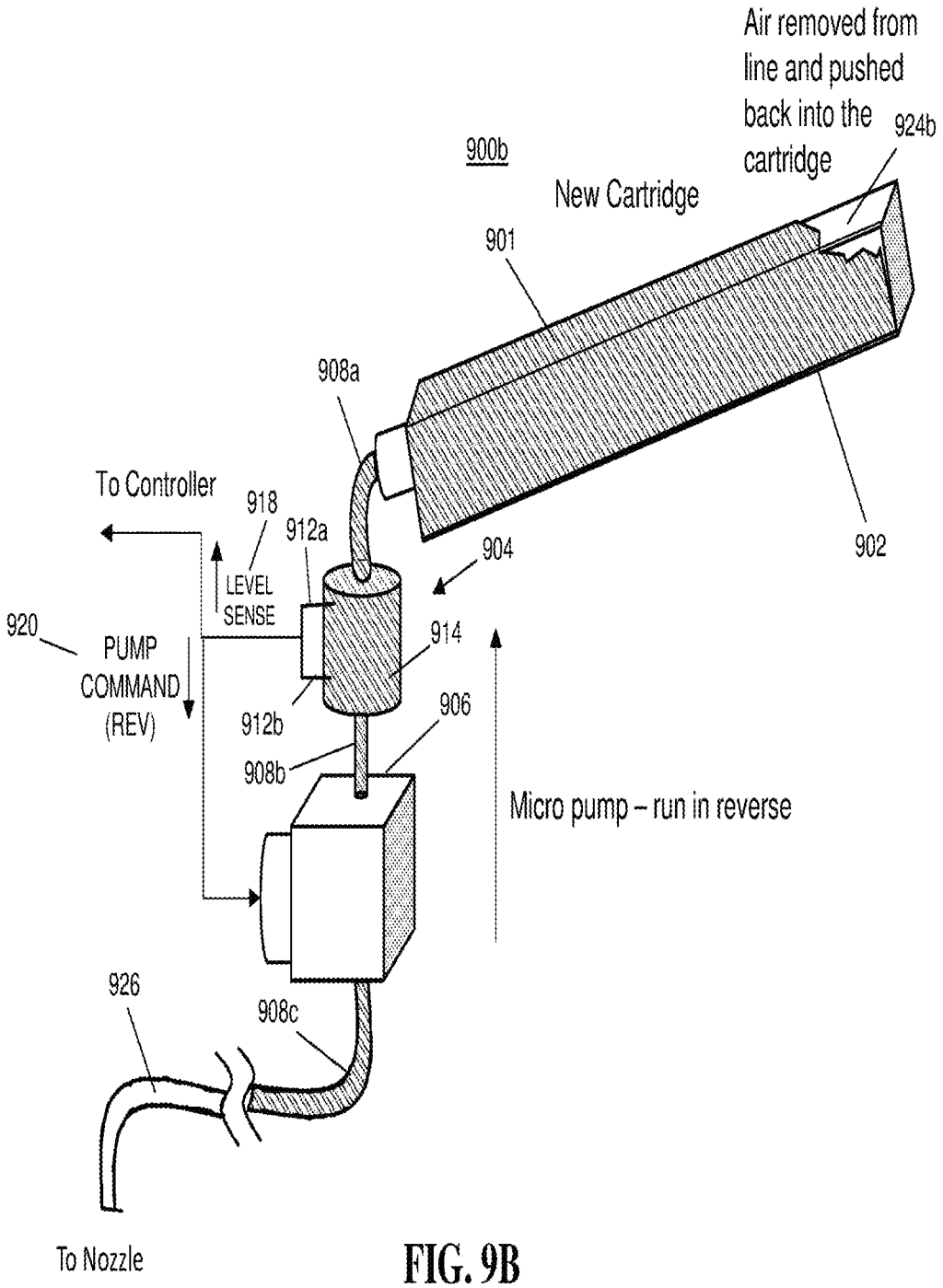
FIG. 9B is an illustration of the portion of the beverage dispenser of FIG. 9A showing the micro-pump running in reverse to push air sensed in a top portion of the level sensor of FIG. 9A back into the ingredient cartridge.
Figure 9C:
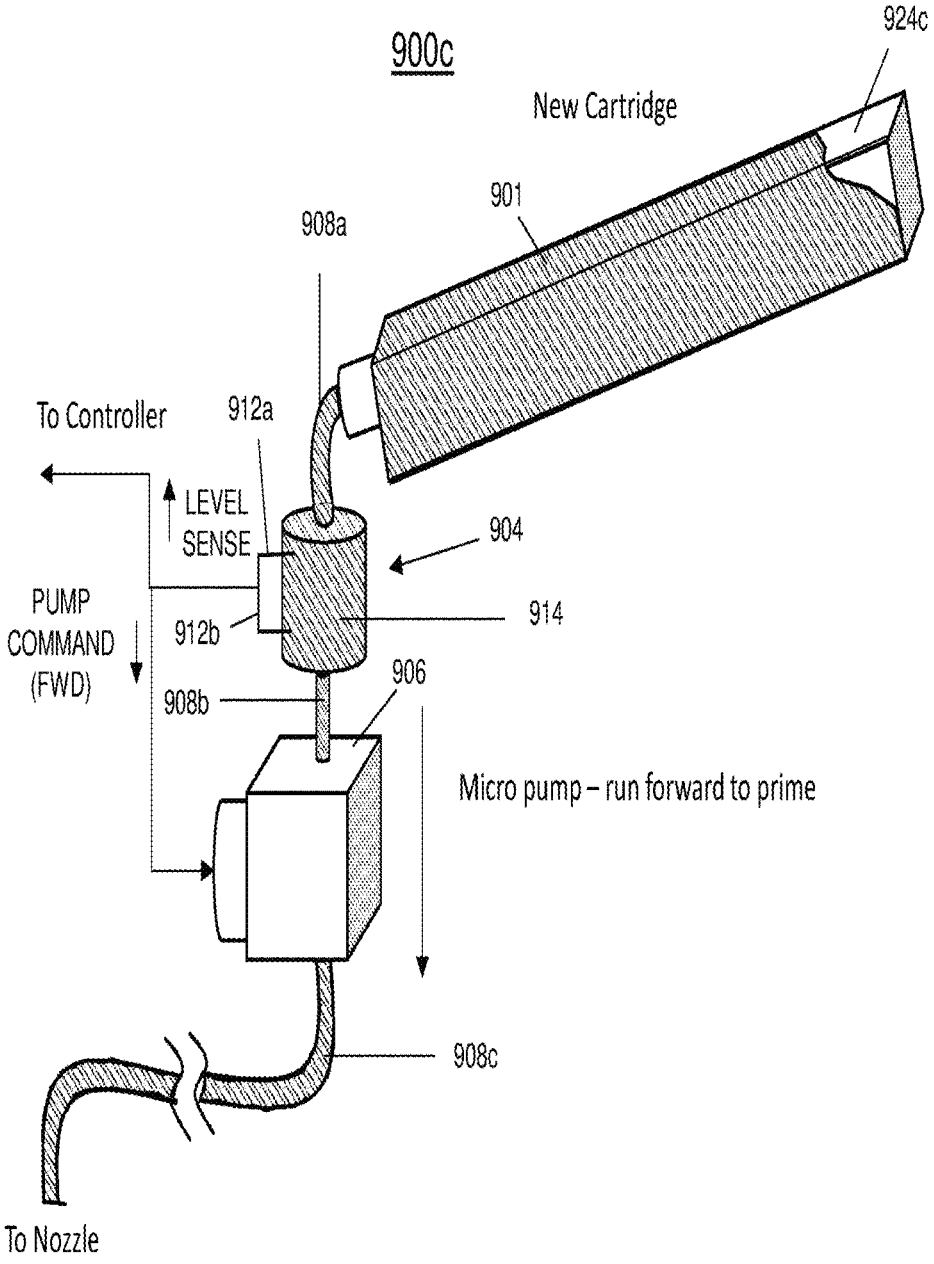
FIG. 9C is an illustration of the portion of the beverage dispenser of FIG. 9A showing the micro-pump running forward to fill or "prime" a fluid path or line to the nozzle with ingredient.

With regard to FIGS. 9A-9C, three successive steps 900*a*-900*c* (collectively 900) of a control process for controlling ingredient flow of a liquid ingredient 901 from an ingredient cartridge 902 are shown. With regard to FIG. 9A, an illustration of an illustrative portion of a beverage dispenser inclusive a new ingredient cartridge 902 along with a level sensor 904, micro-pump 906, and tubing or conduit 908*a*-908*c* that fluidly connects the cartridge 902 to a nozzle (not shown) of a dispenser is shown. At step 900*a*, the ingredient cartridge 902 is shown to be substantially full. When connecting the new ingredient cartridge 902 that is full, air 910 within the fluid conduit 908*a* between the ingredient cartridge 902 and level sensor may exist or be added as a result of a previous ingredient cartridge 902 running empty and being replaced by the new ingredient cartridge. Moreover, the air 910 within the level sensor 904 and conduit 908*a* exists due to the electrodes 912*a* and 912*b* sensing ingredient liquid 914 having a top surface 916 dropping below the electrode 912*a*. A level sense signal 918 may be generated by the level sensor 904, and be communicated to a controller (not shown). Although the ingredient cartridge 902 is substantially full, the amount of actual ingredient that fills the cartridge 902 is not possible to completely fill the cartridge 902 without some level of an air pocket 924*a* being formed. As a result of a cartridge filling process, a small amount of air is typically included in the ingredient cartridge, as understood in the art. It should be understood that the size of the air pocket 924*a* shown is for illustrative purposes, and that a larger or smaller air pocket may be formed during actual filling of the liquid ingredient of the cartridge 902.

As shown in FIG. 9B, in response to the controller receiving the level sense signal 918, the controller may issue a pump command 920 to the micro-pump 906 to instruct the micro-pump 906 to run in reverse to push the air 910 sensed in the top portion of the level sensor 904 and conduit 908*a* of FIG. 9A back into the ingredient cartridge 902 by drawing ingredient fluid from the conduit 908*c* and into the level sensor 904 to push the air 910 in the level sensor 904 and conduit 908*a* into the ingredient cartridge 902. As the air 910 is pushed into the cartridge 902, the air 910 travels to join the air pocket 924*a* to form an air pocket 924*b*. At the same time, as the air 910 is pushed upwards, liquid ingredient 901 may fill the void where the air 910 was previously located in the conduit 908*a* and level sensor 904. As a result of reversing the micro-pump 906, air 926 may enter the conduit 908*c* that thereafter will be pushed back out by running the micro-pump 906 forward, as shown in FIG. 9C.

With regard to FIG. 9C, an illustration of the portion of the beverage dispenser of FIG. 9A showing the micro-pump 904 running forward to fill or "prime" the tubing or conduit 908*c* with ingredient after reversing the micro-pump 904 to clear air from the level sensor 904 and conduit 908*a* is shown. The air 926 of FIG. 9B is shown to be pushed out of the conduit 908*c* during the priming process of FIG. 9C. As a result of the reverse process of FIG. 9B operating the micro-pump 906 a certain amount of time, certain number of turns, or otherwise, the controller may operate the micro-pump 906 in the forward direction the same or substantially similar certain amount of time or certain number of turns to compensate for the air that was brought into the conduit 908*c*, thereby minimizing an amount of ingredient that is "lost" due to a priming process. Available micro-pumps are very accurate such that fluid may be moved backward in the conduit 908*c* and forward in the conduit 908*c* with a high-degree of precision, such as without causing a drop to be expelled from the nozzle. In an embodiment, no minimal ingredient is lost due to the micro-pump 906 being highly accurate. By using the process provided in FIGS. 9A-9C, a minimum (e.g., fewer than two) or no beverages are lost as a result of not having to expel air from the nozzle and/or not purging ingredient from the nozzle during a priming process.

Figure 10:
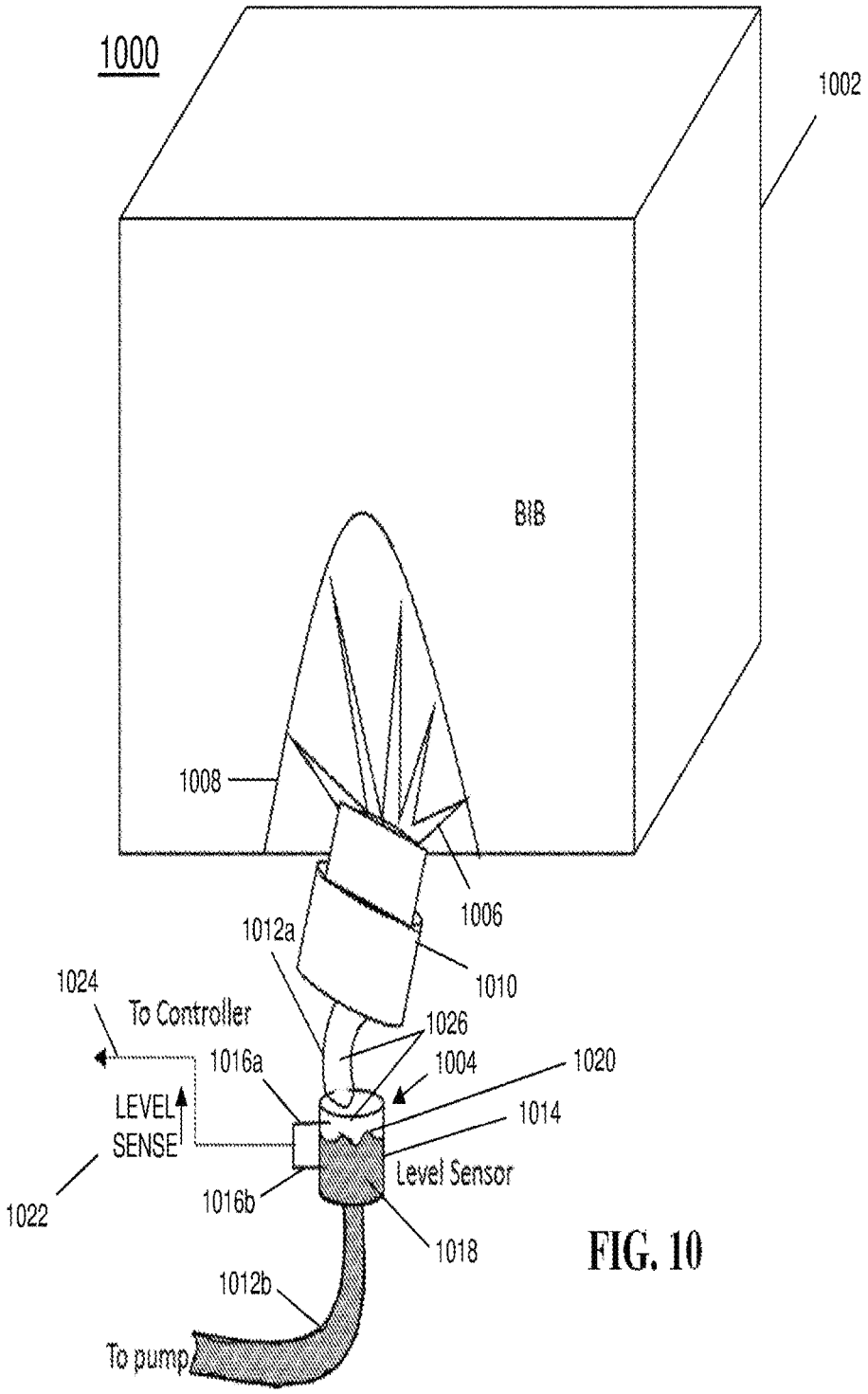
FIG. 10 is an illustration of an illustration portion of a beverage dispenser that includes a macro-ingredient container in the form of a bag-in-a-box (BIB) along with a level sensor used to detect when the ingredient container is empty to cause a controller to stop a pump from pumping the ingredient.

With regard to FIG. 10, an illustration of an illustration portion of a beverage dispenser 1000 that includes a macro-ingredient container 1002 in the form of a bag-in-a-box (BIB) along with a level sensor 1004 used to detect when the macro-ingredient container 1002 is empty to cause a controller (not shown) to stop a pump (not shown) from pumping the macro-ingredient is shown. The macro-ingredient container 1002 is shown to include a bag 1006 contained within a box 1008, as understood in the art of beverage dispensers. It should be understood that alternative configurations of macro-ingredient containers may be utilized in accordance with the principles described herein, as well.

An adapter 1010 may be used to connect the macro-ingredient container 1002 to a conduit 1012*a* to the level sensor 1004, which is further connected to another conduit 1012*b* that is fluidly connected to a pump (not shown). As shown, the level sensor 1004 includes a reservoir 1014 to which a pair of electrodes 1016*a* and 1016*b* are connected to sense ingredient fluid 1018 that flows therethrough and/or is contained therein. As previously described, if the ingredient fluid 1018 has a surface level 1020 that is below the electrode 1016*a* and above the electrode 1016*b*, a level sense signal 1022 may be communicated to a controller (not shown) via an electrical conductor 1024. The controller may use the level sense signal 1022 for controlling the pump. In controlling the pump, the controller may cause the pump to operate in reverse to push air 1026 contained in the reservoir 1014 above the surface 1020 and in the conduit 1012*a* into the bag 1006. Alternatively, the controller may command the pump to prime the fluid path including the conduits 1012*a* and 1012*b* and reservoir 1014 by drawing ingredient from the fluid bag 1006.

Figure 11:
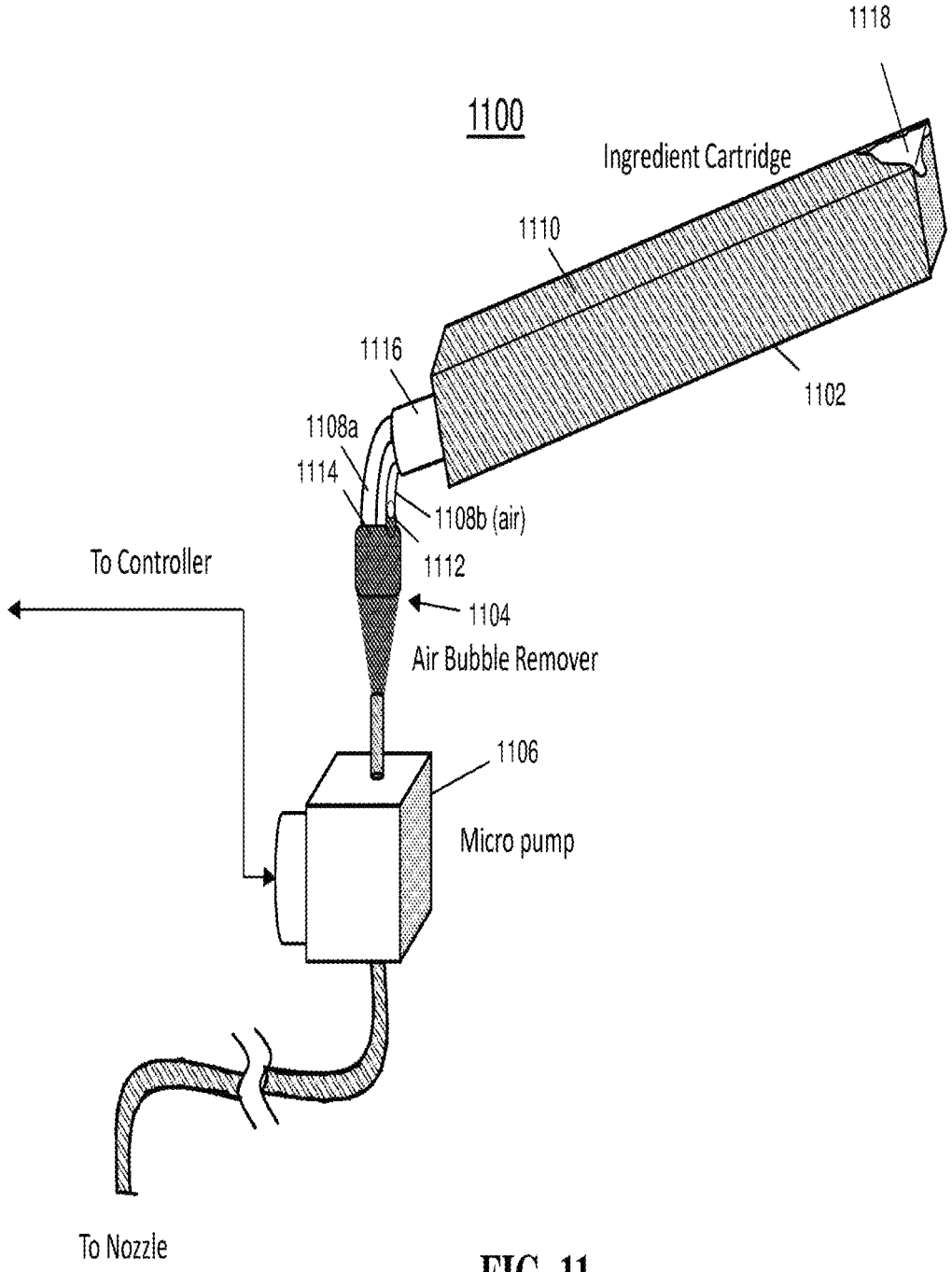
FIG. 11 is an illustration of an alternative embodiment of a beverage dispenser fluid path inclusive of an ingredient cartridge and air bubble remover configured to prevent air from exiting a nozzle.

With regard to FIG. 11, an illustration of an alternative embodiment of a beverage dispenser fluid path 1100 inclusive of an ingredient cartridge 1102 and air bubble remover 1104 configured to prevent air from exiting a nozzle of a beverage dispenser is shown. For the purposes herein, an air bubble may be any amount of air that enters a conduit and/or air bubble remover 1104. The air bubble remover 1104 is a multi-aperture device with at least two apertures at the top to enable liquid ingredient to enter the air bubble remover 1104 and (ii) air to exit the air bubble remover 1104. A micro-pump 1106 may be in fluid communication with the air bubble remover 1104. The air bubble remover 1104 may be in fluid communication with the ingredient cartridge 1102 via a conduit 1108*a* to enable liquid ingredient 1110 to enter the air bubble remover 1104 from the ingredient cartridge 1102. In the event that an air bubble enters into the air bubble remover 1104, a conduit 1108*b* that is smaller in diameter than the conduit 1108*a* may be fed back to the ingredient cartridge 1102. The air bubble remover 1104 may include a spout 1112 that is higher than a top surface 1114 to enable the air bubble to travel upwards to the ingredient cartridge 1102 via the conduit 1108*b*. In an embodiment, the air bubble remover 1104 may be installed at an angle or have an upper inside surface (not shown) that is angular that causes air to travel to the spout 1112 for feeding back into the ingredient cartridge 1102.

A connector 1116 may be configured to enable and/or force the air bubble to enter back into the ingredient cartridge 1102. In an embodiment, the ingredient cartridge 1102 may be a conventional ingredient cartridge 1102, and the conduit 1108*b* may be fluidly connected to the conduit 1108*a* inside the connector 1116. Alternatively, the ingredient cartridge 1102 may be modified to enable the conduit 1108*b* to be fluidly connected to the ingredient cartridge. Any air that is removed from the fluid path via the air bubble remover 1104 and conduit 1108*b* that enters the ingredient cartridge 1102 may be joined with air 1118 in the ingredient cartridge 1102 as a result of the ingredient cartridge being angled upwards, as shown. The air bubble remover 1104 may prevent air from entering the micro-pump 1106 as a result of being upstream of the micro-pump 1106. It should be understood that the air bubble remover 1104 may be utilized in other configurations that do not include a micro-pump, such as configurations with other sized pumps or no pump, such as the configuration of FIG. 10. It should also be understood that the same or similar configuration may be used for macro-cartridge fluid paths.

Figure 12:
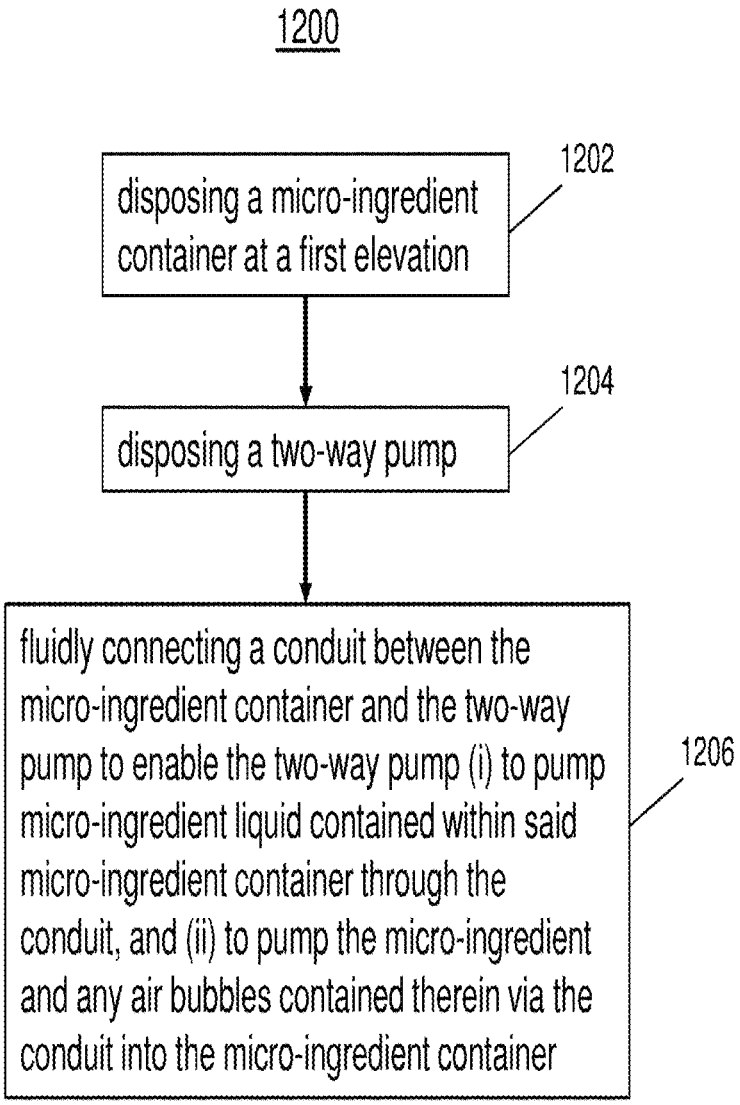
FIG. 12 is a flow diagram of an illustrative process for manufacturing a beverage dispenser.

With regard to FIG. 12, a flow diagram of an illustrative process 1200 for manufacturing a beverage dispenser is shown. The process 1200 may include disposing a micro-ingredient container containing micro-ingredient to be dispensed by the beverage dispenser at step 1202. At step 1204, a two-way pump may be disposed in the beverage dispenser. At step 1206, a conduit may be fluidly connected between the micro-ingredient container and the two-way pump to enable the two-way pump (i) to pump micro-ingredient liquid contained within the micro-ingredient container through the conduit, and (ii) to pump the micro-ingredient and any air bubbles contained therein via the conduit into the micro-ingredient container.

An air bubble sensor may be positioned along the conduit that senses air that enters the conduit. The air bubble sensor may be positioned closer to the micro-ingredient container than the two-way pump. The two-way pump may be a micro-pump. A level sensor may be fluidly connected between the two-way pump and the micro-ingredient container. The level sensor may be communicatively connected to a processing unit that, in response to sensing that the level sensor has air contained therein, may be configured to cause the pump to reverse pump to push the air into the micro-ingredient container. A multi-aperture device may be fluidly connected along the conduit between the micro-ingredient container and the two-way pump, where the multi-aperture device may include first and second apertures positioned at a top portion of the multi-aperture device and a third aperture at a bottom portion of the multi-aperture device. A first of the apertures may have a larger diameter than a second of the apertures at the top portion. A first conduit may be fluidly connected to the first aperture, a second conduit to the second aperture, and a third conduit to the third aperture.

One embodiment of a process of dispensing a beverage may include pumping a micro-ingredient from a micro-ingredient container via a fluid path toward a nozzle to dispense a beverage inclusive of the micro-ingredient. The micro-ingredient may be reverse pumped via the fluid path back to the micro-ingredient container to cause an air bubble in the fluid path to be pushed into the micro-ingredient container.

Reverse pumping the micro-ingredient may include reverse pumping a predetermined amount of time, number of turns of a pump, fluid distance, or otherwise. The process may further include sensing an air bubble in the fluid path, and, in response to sensing the air bubble, causing a bi-directional pump to transition from forward pumping to reverse pumping to cause the air bubble to be pushed into micro-ingredient container. Reverse pumping the micro-ingredient may include reverse pumping the micro-ingredient until the air bubble is no longer sensed. Sensing the air bubble may include sensing the air bubble at a location closer to the micro-ingredient container than the bi-directional pump used to reverse pump the micro-ingredient via the fluid path. By sensing the air bubble closer to the micro-ingredient container than the bi-directional pump, the ability to reverse pump the air bubble back into the container is easier. It is noted that if the volume of conduit below the location of sensing is insufficient to pump the air bubble to the container, then such an ability would not be possible. Sensing an air bubble may include sensing whether the air bubble changes while the micro-ingredient is being reverse pumped, and wherein if the air bubble does not change, a parameter indicative that the micro-ingredient container is empty may be set, and the micro-ingredient may be prevented from pumping either forward or reverse.

In an embodiment, a process for determining whether the fluid container is empty or whether air remains in the fluid path as a result of a fluid container recently being replaced (e.g., determination as to an amount of time or fluid that has passed since the fluid container was last replaced). In an embodiment, if the pump is reversed for a certain time period or distance and the air bubble remains, then a determination that the fluid container is empty may be made.

An embodiment of a beverage dispenser may include an ingredient container including an ingredient used to produce a beverage. A bi-directional pump may be configured to pump fluid in either of a forward direction or a reverse direction. A first conduit may be fluidly connected to the ingredient container and bi-directional pump. A nozzle may be configured to output beverage ingredients from the beverage dispenser. A second conduit may be fluidly connected to the bi-directional pump and the nozzle. A processing unit may be in communication with the bi-directional pump, and be configured to command the bi-directional pump to pump the ingredient in a forward direction or a reverse direction.

The ingredient container may be a micro-ingredient container, and the ingredient may be a micro-ingredient. A level sensor may be in electrical communication with the processing unit, and may be configured to communicate a level sense signal to the processing unit in response to determining that a level of the ingredient is below a certain level. The processing unit may further be configured to instruct the bi-directional pump to reverse a predetermined amount of time or number of turns to cause air within the first conduit and level sensor to be pushed into the ingredient container. The processing unit may further be configured to instruct the bi-directional pump to forward the predetermined amount of time or number of turns to cause air brought into the second conduit to be pushed out of the nozzle.

The foregoing method descriptions and the process flow diagrams are provided merely as illustrative examples and are not intended to require or imply that the steps of the various embodiments must be performed in the order presented. As will be appreciated by one of skill in the art, the steps in the foregoing embodiments may be performed in any order. Words such as "then," "next," etc. are not intended to limit the order of the steps; these words are simply used to guide the reader through the description of the methods. Although process flow diagrams may describe the operations as a sequential process, many of the operations may be performed in parallel or concurrently. In addition, the order of the operations may be re-arranged. A process may correspond to a method, a function, a procedure, a subroutine, a subprogram, etc. When a process corresponds to a function, its termination may correspond to a return of the function to the calling function or the main function.

The various illustrative logical blocks, modules, circuits, and algorithm steps described in connection with the embodiments disclosed here may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

Embodiments implemented in computer software may be implemented in software, firmware, middleware, microcode, hardware description languages, or any combination thereof. A code segment or machine-executable instructions may represent a procedure, a function, a subprogram, a program, a routine, a subroutine, a module, a software package, a class, or any combination of instructions, data structures, or program statements. A code segment may be coupled to and/or in communication with another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

The actual software code or specialized control hardware used to implement these systems and methods is not limiting of the invention. Thus, the operation and behavior of the systems and methods were described without reference to the specific software code being understood that software and control hardware can be designed to implement the systems and methods based on the description here.

When implemented in software, the functions may be stored as one or more instructions or code on a non-transitory computer-readable or processor-readable storage medium. The steps of a method or algorithm disclosed here may be embodied in a processor-executable software module which may reside on a computer-readable or processor-readable storage medium. A non-transitory computer-readable or processor-readable media includes both computer storage media and tangible storage media that facilitate transfer of a computer program from one place to another. A non-transitory processor-readable storage media may be any available media that may be accessed by a computer. By way of example, and not limitation, such non-transitory processor-readable media may comprise RAM, ROM, EEPROM, CD-ROM or other optical disk storage, magnetic disk storage or other magnetic storage devices, or any other tangible storage medium that may be used to store desired program code in the form of instructions or data structures and that may be accessed by a computer or processor. Disk and disc, as used here, include compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and/or instructions on a non-transitory processor-readable medium and/or computer-readable medium, which may be incorporated into a computer program product.

The previous description is of a preferred embodiment for implementing the invention, and the scope of the invention should not necessarily be limited by this description. The scope of the present invention is instead defined by the following claims.

What is claimed:

1. A beverage dispenser for dispensing beverages, comprising:

a fluid container containing a fluid ingredient;

a conduit fluidly connected to the fluid container; and an electrical conductivity sensor (i) fluidly connected to the conduit and (ii) configured to sense an electrical conductivity of the fluid ingredient flowing through the conduit, the electrical conductivity sensor further configured to output (i) a first electrical signal in response to sensing an air bubble and (ii) a second electrical signal in response to not sensing an air bubble.

2. The beverage dispenser of claim 1, further comprising:

a processing unit configured to generate electrical conductivity measurements in response to receiving the first and second electrical signals from the electrical conductivity sensor, and further being configured to:

determine, based on the electrical conductivity measurements, that an air bubble is contained in the fluid ingredient within the conduit; and prevent the fluid ingredient from being dispensed in response to determining that an air bubble is contained in the fluid ingredient within the conduit.

3. The beverage dispenser of claim 1, further comprising:

a pump configured to reverse pump the fluid ingredient and the air bubble contained therein back into the fluid container.

4. The beverage dispenser of claim 3, wherein the pump is a two-way pump configured to forward pump the fluid ingredient from the fluid container to a nozzle configured to dispense a beverage with the fluid ingredient, and to reverse pump the fluid ingredient and the air bubble container back into the fluid container.

5. The beverage dispenser of claim 4, further comprising:

a processing unit configured to generate electrical conductivity measurements in response to receiving the first and second electrical signals from the electrical conductivity sensor, and further being configured to:

determine, based on the electrical conductivity measurements, that an air bubble is contained in the fluid ingredient within the conduit; and cause the two-way pump to pump in reverse to cause the air bubble to be pushed back into the fluid container via the conduit in response to determining that an air bubble is contained in the fluid ingredient within the conduit.

6. The beverage dispenser of claim 1, further comprising a level sensor configured to output a sensor measurement corresponding to a presence of an air bubble in the conduit.

7. The beverage dispenser of claim 6, further comprising:

a processing unit communicably coupled to the level sensor and the electrical conductivity sensor, the processing unit being configured to:

determine, based on the first electrical signal or the second electrical signal from the electrical conductivity sensor or the sensor measurement from the level sensor, that an air bubble is contained in the fluid ingredient within the conduit; and cause fluid within the conduit to be pumped from the conduit into the fluid container, to cause the air bubble to be pushed into the fluid container via the conduit.

8. The beverage dispenser of claim 1, wherein the fluid container is a micro-ingredient container, and wherein the fluid is a micro-ingredient for a beverage to be dispensed from the beverage dispenser.

9. A method of dispensing beverages from a beverage dispenser, the method comprising:

pumping a fluid ingredient from a fluid container via a fluid path toward a nozzle to dispense a beverage inclusive of the fluid ingredient;

sensing an electrical conductivity of the fluid ingredient in a conduit of the fluid path by an electrical conductivity sensor; and generating an electrical conductivity sense signal by the electrical conductivity sensor along the fluid path based on the electrical conductivity of the fluid ingredient within the conduit, the electrical conductivity sensor generating a first signal in response to sensing that an air bubble is contained in the fluid ingredient within the conduit or a second signal in response to not sensing an air bubble.

10. The method of claim 9, further comprising:

determining, based on the electrical conductivity sense signal, that an air bubble is contained in the fluid ingredient within the conduit; and preventing the fluid ingredient from being dispensed in response to determining that the air bubble is contained in the fluid ingredient within the conduit.

11. The method of claim 9, further comprising pumping, using a pump fluidly coupled to the conduit, the fluid ingredient and the air bubble contained therein back into the fluid container.

12. The method of claim 11, wherein the pump is a two-way pump, and wherein pumping the fluid ingredient includes pumping, using the two-way pump, the fluid ingredient from the fluid container into the conduit, and wherein the method further comprises:

reverse pumping, using the two-way pump responsive to the electrical conductivity sense signal indicating that an air bubble is contained in the fluid ingredient within the conduit, the fluid ingredient and the air bubble contained therein back into the fluid container.

13. The method of claim 11, further comprising determining, based on a sensor measurement from a level sensor, that an air bubble is present in the conduit.

14. The method of claim 13, further comprising:

determining, based on the electrical conductivity sense signal or the sensor measurement, that an air bubble is contained in the fluid ingredient within the conduit; and cause fluid within the conduit to be pumped from the conduit back into the fluid container, to cause the air bubble to be pushed into the fluid container via the conduit.

15. The method of claim 9, wherein the fluid container is a micro-ingredient container, and wherein the ingredient is a micro-ingredient for a beverage to be dispensed from the beverage dispenser.

16. A beverage dispenser, comprising:

a fluid container containing a fluid ingredient;

a conduit fluidly connected to the fluid container;

an electrical conductivity sensor fluidly connected to the conduit and configured to sense an electrical conductivity of the fluid ingredient flowing through the conduit, the electrical conductivity sensor configured to output (i) a first electrical signal in response to sensing an air bubble and (ii) a second electrical signal in response to not sensing an air bubble;

a pump configured to pump the fluid ingredient from the conduit back into the fluid container based on the first electrical signal; and a nozzle fluidly connected to the conduit, and configured to dispense a beverage inclusive of the fluid ingredient.

17. The beverage dispenser of claim 16, further comprising:

a processing unit configured to generate electrical conductivity measurements in response to receiving the first and second electrical signals from the electrical conductivity sensor, and further being configured to:

determine, based on the electrical conductivity measurements, that an air bubble is contained in the fluid ingredient within the conduit; and cause the pump to pump in reverse to cause the air bubble to be pushed into the fluid container via the conduit in response to determining that an air bubble is contained in the fluid ingredient within the conduit.

18. The beverage dispenser of claim 17, wherein in the pump is a two-way pump, and wherein the processing unit is further configured to cause the pump to pump fluid forward from the fluid container into the conduit.

19. The beverage dispenser of claim 16, further comprising:

a level sensor configured to output a sensor measurement corresponding to a presence of an air bubble in the conduit, wherein the pump is configured to pump the fluid back into the fluid container based on the sensor measurement.

20. The beverage dispenser of claim 16, wherein the electrical conductivity sensor is positioned at the nozzle.

* * * * *